US007867384B2

(12) United States Patent
Coveley

(10) Patent No.: US 7,867,384 B2
(45) Date of Patent: Jan. 11, 2011

(54) APPARATUS, SYSTEM, AND METHOD FOR SEPARATING BITUMEN FROM CRUDE OIL SANDS

(76) Inventor: Michael E. Coveley, 6 Fairview Avenue, Richmond Hill, Ontario (CA) L4C 6L2

( * ) Notice: Subject to any disclaimer, the term of this patent is extended or adjusted under 35 U.S.C. 154(b) by 176 days.

(21) Appl. No.: 11/783,420

(22) Filed: Apr. 9, 2007

(65) Prior Publication Data

US 2008/0035531 A1 Feb. 14, 2008

Related U.S. Application Data

(60) Provisional application No. 60/789,922, filed on Apr. 7, 2006.

(51) Int. Cl.
*C10G 1/04* (2006.01)

(52) U.S. Cl. ..... 208/390; 204/157.15; 204/157.42; 204/157.62; 210/512.1

(58) Field of Classification Search ..... 208/390; 209/127–127.31, 696–697; 137/13; 204/157.15–157.62; 210/512.1–512.3

See application file for complete search history.

(56) References Cited

U.S. PATENT DOCUMENTS 4,331,532 A * 5/1982 Bose ..... 208/391
4,443,322 A * 4/1984 Jubenville ..... 208/391
4,891,131 A * 1/1990 Sadeghi et al. ..... 208/390

OTHER PUBLICATIONS

Mason, T.J. et al. (2002). Applied Sonochemistry: Uses of Power Ultrasound in Chemistry and Processing, Wiley-VCH, 303 pgs. (p. 56 referenced in Office action).*

* cited by examiner

*Primary Examiner*—Robert J Hill, Jr.
*Assistant Examiner*—Brian McCaig
(74) *Attorney, Agent, or Firm*—Harness, Dickey & Pierce, P.L.C.

(57) ABSTRACT

A method for separating bitumen from crude oil sands comprises subjecting crude oil sands to vibration selected to cause bitumen to separate from crude oil sands and filtering the separated bitumen from the crude oil sands.

26 Claims, 24 Drawing Sheets

APPARATUS, SYSTEM, AND METHOD FOR SEPARATING BITUMEN FROM CRUDE OIL SANDS

CROSS-REFERENCE TO RELATED APPLICATIONS

This application claims the benefit of U.S. Provisional Application No. 60/789922 filed on Apr. 7, 2006, the content of which is incorporated by reference.

FIELD OF THE INVENTION

The following broadly relates to a method of separating liquid from colloidal mixtures. More specifically, the following relates to a method, apparatus and system for separating bitumen from crude oil sands.

BACKGROUND OF THE INVENTION

As is well known, tar sand or crude oil sand deposits are sands that are impregnated with crude/heavy oil also known as bitumen. Crude oil sands are typically overlain by various types of overburden media such as for example, muskeg, clay, soil and gravel. Existing systems of extracting bitumen from crude oil sand deposits utilize similar practices to those employed in strip mining of coal. As a result, these systems are heavily reliant on excavating shovels, draglines, trucks, gnawing/crushers or sizers to break down large lumps of crude oil sands to form crushed amassed aggregates. The crushed amassed aggregates are then transported to an extraction plant at some distance away for further processing. Alternatively, the crushed amassed aggregate are turned into slurry and transported to the extraction plant by cycloid feeders (also known as hydro-transport).

At the extraction plant, the bitumen is separated from sand and other media and upgraded for processing. The partially de-oiled sand residue (also known as tailings) if loose, is transported by truck to a tailing pond. If the de-oiled same residue is in slurry form, the residue is pumped by pipeline to the tailing pond.

These existing practices for extracting crude oil sands and recovering bitumen require vast amounts of energy and thus, contribute to excessive greenhouse gas production. These existing extraction practices also place extensive abrasive wear and tear on the processing equipment being used. Back-up machinery on stand-by is therefore often required to replace damaged equipment or components leading to additional expense. In addition, mining during the winter months is problematic owing to the freezing of the crude oil sands. These factors make existing practices for extracting bitumen from crude oil sands inefficient.

Currently, existing bitumen extraction practices require two (2)-tons of crude oil sands to recover one (1) barrel of oil and the process releases into the atmosphere more than ninety (90) Kg of greenhouse gases per barrel of recovered oil. In addition, up to five (5) barrels of contaminated wastewater per barrel of recovered oil are generated. The wastewater is typically dumped into accumulation sites with the wastewater eventually leaching into ground water. As will be appreciated from the above, the environmental consequences of existing crude oil sand extraction practices will clearly continue to violate Canada's commitments to the Kyoto Protocol to reduce greenhouse gas emissions by 6% by the year 2012.

Because the mining of crude oil sands using present day systems is a costly and inefficient process, there exists a need for more efficient and reliable systems. It is therefore an object of the present invention to provide a novel method, apparatus and system for separating bitumen from crude oil sands.

SUMMARY OF THE INVENTION

Accordingly, in one aspect there is provided a method for separating bitumen from crude oil sands comprising:

- subjecting crude oil sands to vibration selected to cause bitumen to separate from crude oil sands; and
- filtering the separated bitumen from said crude oil sands.

According to another aspect there is provided a trough assembly for separating liquid from a colloidal mixture, said trough assembly comprising:

- a trough for receiving said colloidal mixture;
- at least one vibration source to vibrate said colloidal mixture to cause liquid to separate from said colloidal mixture; and
- a filter in said trough through which separated liquid flows.

According to yet another aspect there is provided an apparatus for separating bitumen from crude oil sands, said apparatus comprising:

- a plurality of trough assemblies in operative working vertical series, each of said trough assemblies comprising:
  - a trough for receiving crude oil sands;
  - at least one vibration source to vibrate said crude oil sands to cause bitumen to separate from said media; and
  - a filter in said trough through which separated bitumen flows.

According to still yet another aspect there is provided a system for excavating crude oil sands and separating bitumen from crude oil sands, said system comprising:

- at least one dredge to float in a liquid reservoir formed in a crude oil sand deposit, said dredge comprising an excavator for excavating crude oil sands and a separation apparatus receiving crude oil sands from said excavator and processing said crude oil sands to separate bitumen from said crude oil sands.

According to still yet another aspect there is provided a method for separating bitumen from crude oil sands comprising:

- forming a tarn in a crude oil sand deposit;
- positioning a dredge in said tarn;
- excavating said crude oil sand with said dredge; and
- processing the crude oil sand to separate bitumen therefrom.

BRIEF DESCRIPTION OF THE DRAWINGS

Embodiments will now be described, by way of example only, with reference to the attached drawings, wherein.

DETAILED DESCRIPTION OF THE EMBODIMENTS

The following broadly relates to a method, apparatus and system for separating liquid from a colloidal mixture and in particular, bitumen from crude oil sands. One or more self-contained mobile recovery dredges are used to harmonically and chemically separate bitumen from crude oil sands at the site of the tar/crude oil sand deposit. Embodiments will now be described more fully with reference to the FIGS. 1 to 19.

Figure 1:
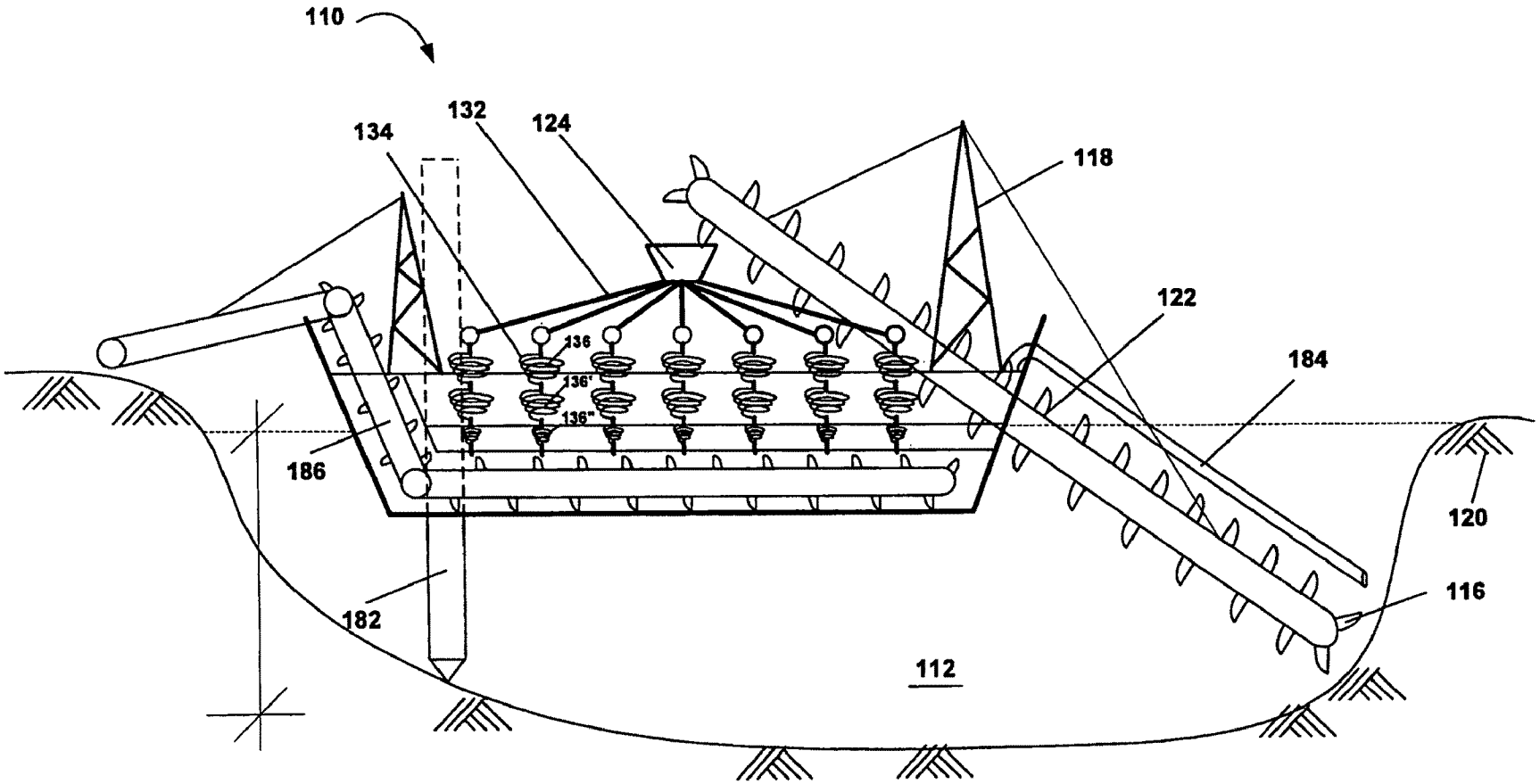
FIG. 1 is a side elevation view of a recovery dredge in a tarn.
Figure 2:
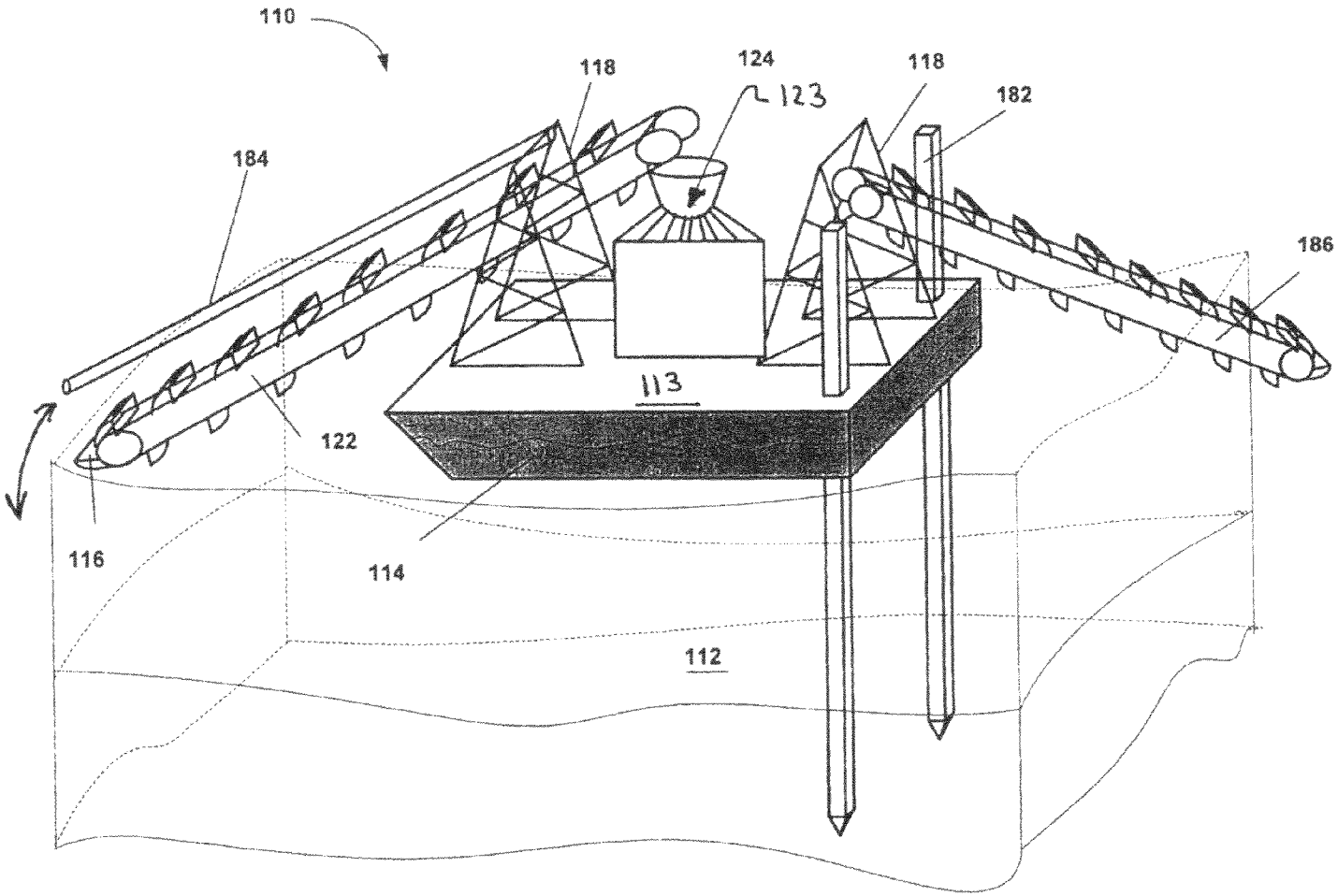
FIG. 2 is a perspective view of the recovery dredge of FIG. 1.

Shown in FIGS. 1 and 2 is a side elevation view and a perspective view, respectively of a crude oil sand recovery dredge 110 in an artificial tarn or reservoir 112 formed in a crude oil sand deposit to be excavated. Dredge 110 comprises a deck 113 supported on pontoons 114 and floats on water or brackish water in tarn 112. Dredge 110 also comprises a swingable dredge cutting head 116 (otherwise known as an oil sand excavator) at its forward end that is supported by a powered gantry 118 mounted on the deck 113. The cutting head 116 has cutting and grinding surfaces that are used to excavate crude oil sands 120. Crude oil sands 120 comprise a non-homogenous mixture of bitumen and other types of media such as, but not limited to, clay and sand. The excavated crude oil sands 120 are drawn up along a conveyor belt 122 with any excess water being removed by filtration and gravity-assisted drainage. Conveyor belt 122 feeds the excavated crude oil sands to a crude oil sand processing apparatus 123 generally centrally positioned on the deck 113. Processing apparatus 123 processes excavated crude oil sands to separate bitumen from the remainder of the crude oil sands (i.e. tailings). A swingable dragline 186 extending from the rear end of the dredge 110 is also supported by a powered gantry 118 mounted on the deck 113. The dragline 186 delivers the tailings into the tarn 112 to backfill the tarn as the dredge 110 advances.

In this embodiment, the crude oil sand separation apparatus 123 comprises a pair of churns 126 and 130 disposed above a distribution hopper 124. Hopper 124 communicates with a plurality of separation apparatuses 134, each separation apparatus 134 comprising a plurality of trough assemblies 136 connected in series. Further specifics of the crude oil sand separation apparatus 123 will now be described.

Figure 3A:
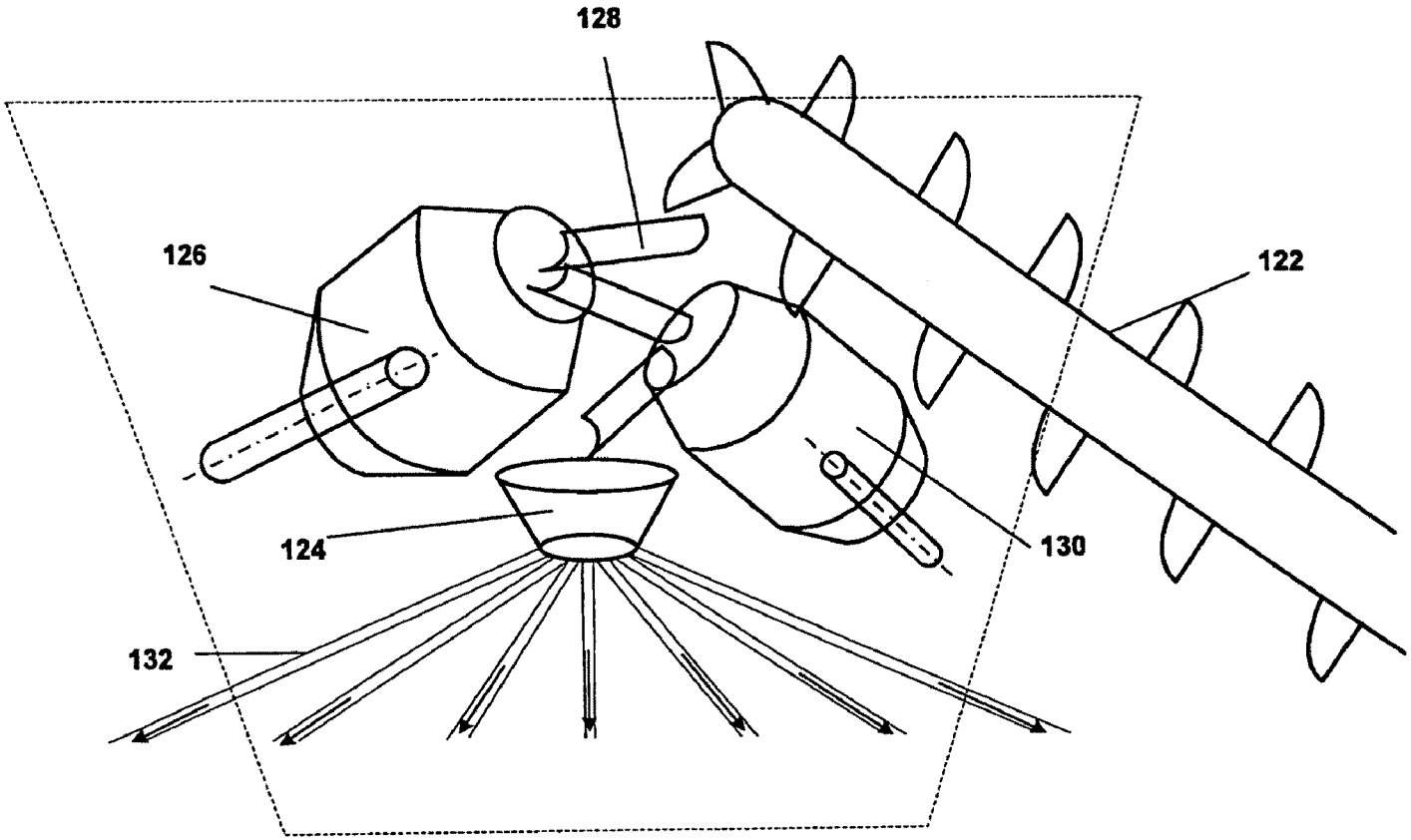
FIG. 3*a* is a perspective view of first and second churns forming part of the recovery dredge of FIG. 1.

Turning to FIG. 3*a*, the churns 126 and 130 are better illustrated. As can be seen, conveyor belt 122 feeds the excavated crude oil sands into the first churn 126 via a plurality of chutes 128 (otherwise known as deflectors). First churn 126 heats the crude oil sands 120 with hot water by way of a steam jacket or a calorifier to soften the crude oil sands 120. The first churn 126 also acts as a dehumidifier for the crude oil sands 120 to remove any excess moisture in the crude oil sands 120. Dehumidification in this embodiment is accomplished using compressed carbon dioxide ($CO_2$) gas (e.g. at about 20 bar) which forms dry-ice in an auto-refrigeration process. The first churn 126 may also contain infrared systems that serve to dry the crude oil sands 120. The crude oil sands 120 are then fed into the second churn 130 where various extraction agents such as caustic soda (otherwise known as NaOH) are used to catalyze the separation of bitumen from crude oil sands 120.

Figure 3B:
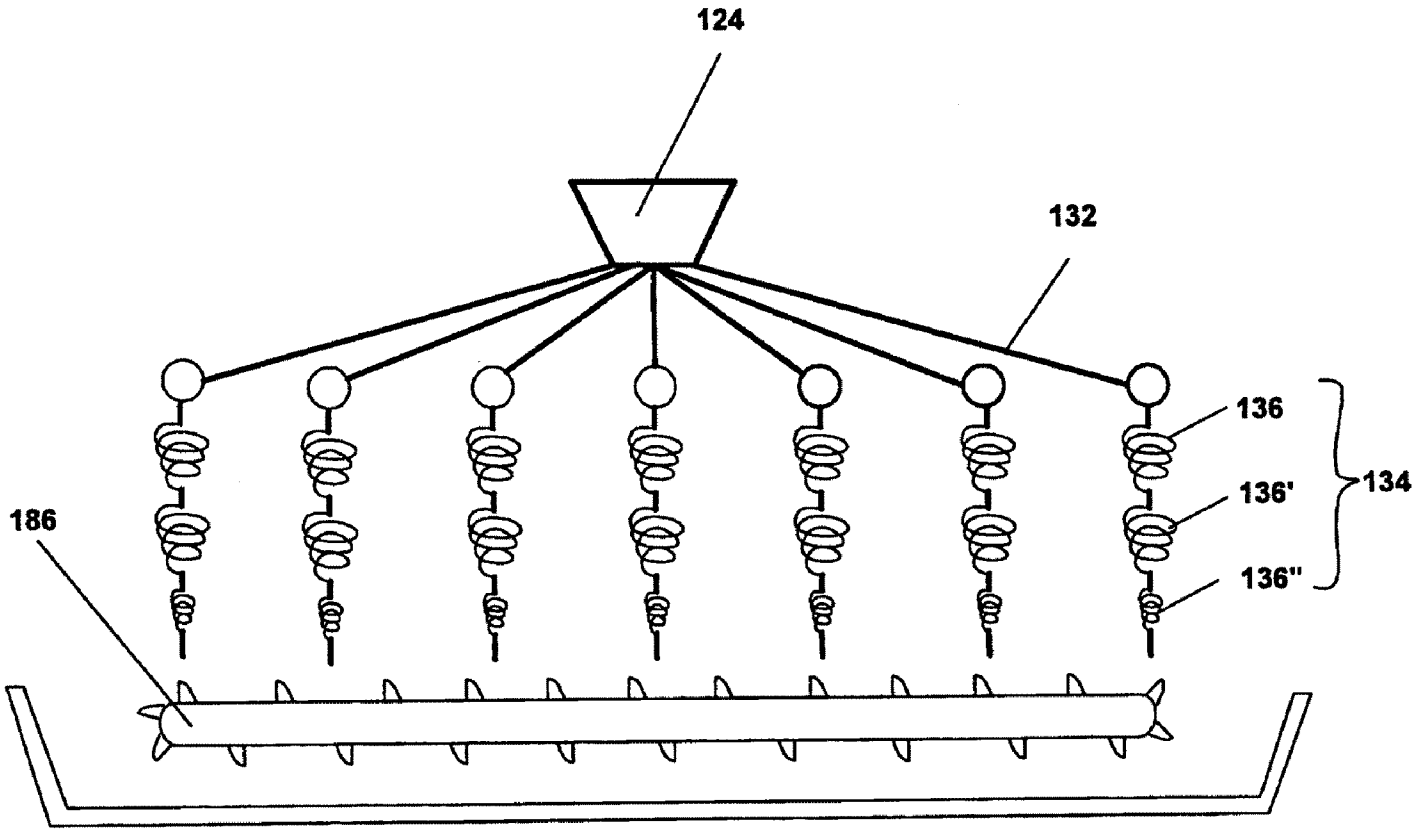
FIG. 3*b* is a side elevation view of a crude oil sand separation apparatus forming part of the recovery dredge of FIG. 1.
Figure 4:
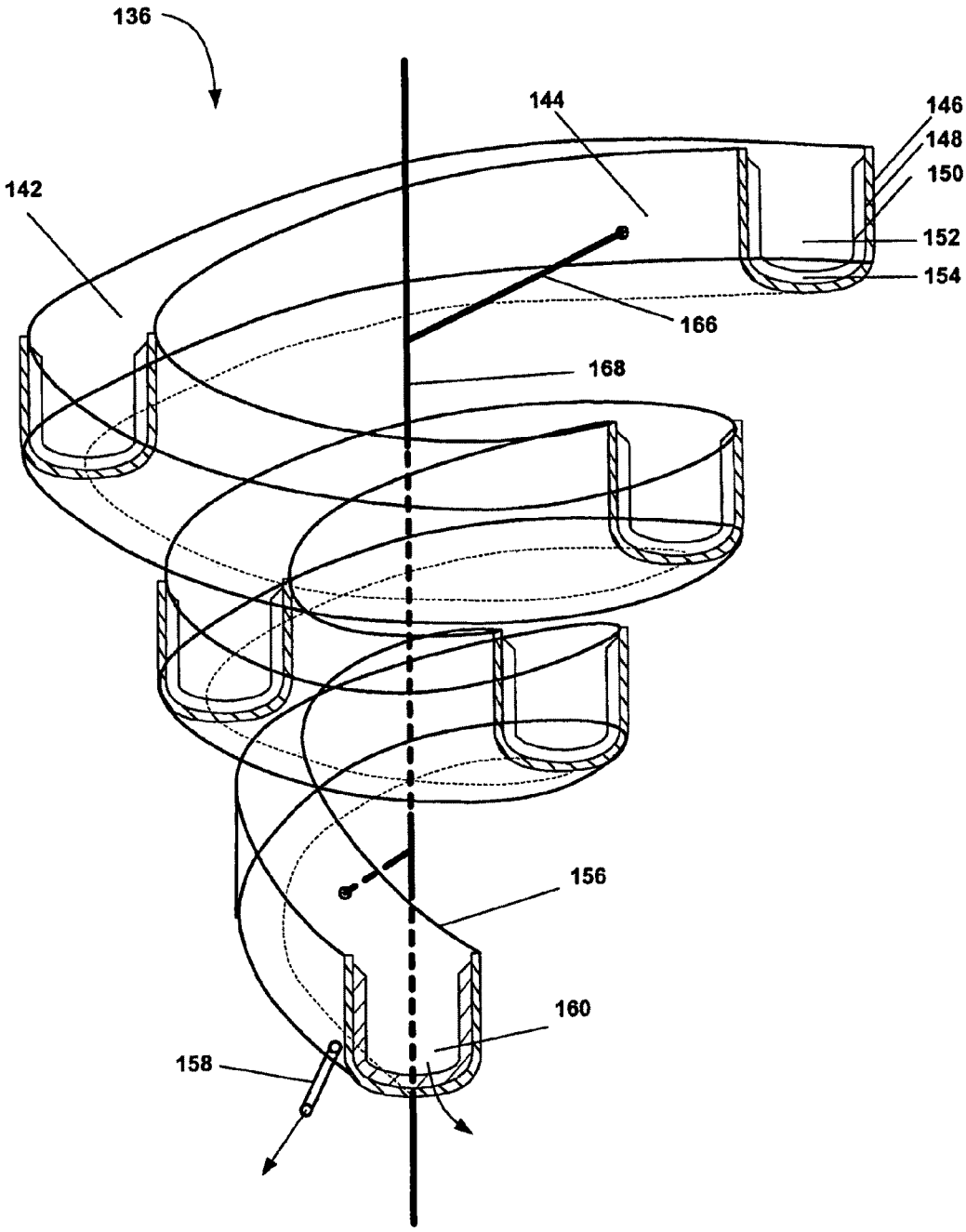
FIG. 4 is a side elevation view, partly in section, of a trough assembly comprising a separation trough.
Figure 5:
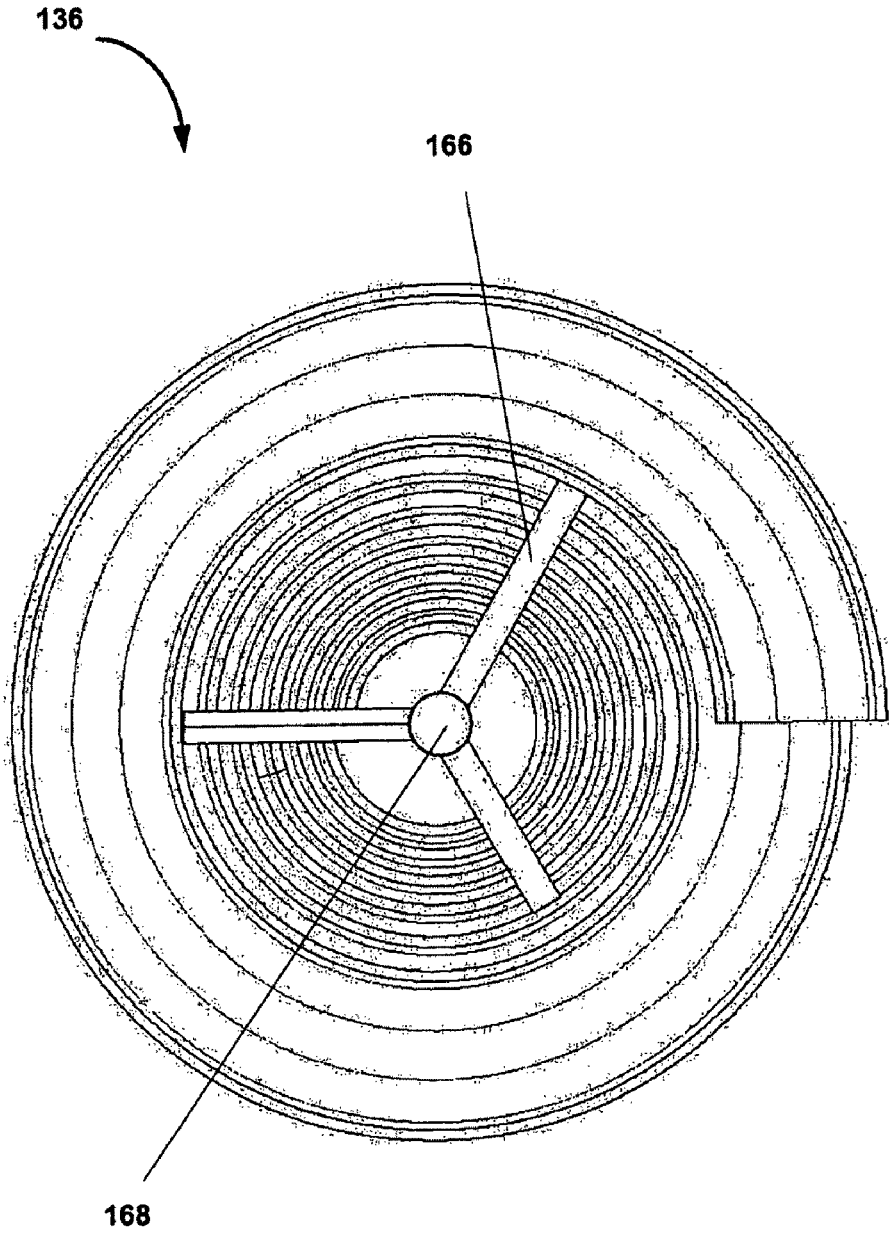
FIG. 5 is a top plan view of the trough assembly of FIG. 4.

As can be seen in FIG. 3*b*, after exiting the first and second churns 126 and 130, the resultant colloidal mixture of crude oil sands 120 is then fed to the distribution hopper 124. Crude oils sands 120 from the distribution hopper 124 are then fed in parallel to a plurality of distribution troughs 132. Each distribution trough 132 is operatively coupled to one of the separation apparatuses 134. In this embodiment, each separation apparatus 134 comprises three (3) trough assemblies connected in series although fewer or more trough assemblies may be employed. Each trough assembly 134 employs at least one of harmonic and chemical techniques to separate bitumen from crude oil sands.

Turning now to FIGS. 4 to 10, one of the trough assemblies 136 is better illustrated. As can be seen, each trough assembly 136 comprises a downwardly depending separation trough 142 that is adapted to receive crude oils sands 120 from a top or head portion 144. Separation trough 142 spirals around and is mounted to a central support stem 168 by radially extending support members 166. Separation trough 142 has an outer wall 146 and an inner wall 148. Spaced inwardly from inner wall 148 is a mesh screen 150. Mesh screen 150 acts as a filter and divides the interior of the separation trough 142 into an oil sand receiving channel 152 and a bitumen collection channel 154.

Adjacent the bottom portion 156 (otherwise known as tail portion) of trough assembly 136 there is provided a bitumen discharge outlet 158 and a de-oiled media (otherwise known as the dry filtrate) discharge outlet 160. Bitumen discharge outlet 158 directs extracted bitumen collected in collection channel 154 to a bitumen storage vessel (not shown) on dredge 110 prior to the delivery to an off-site facility for further processing. De-oiled media discharge outlet 160 directs the de-oiled media either to the next trough assembly in the series or to the dragline 186.

While an open-topped trough assembly 136 is shown, it will be understood that depending on the volume of crude oil sand 120, it may be desirable to fit a retaining cap over the separation trough 142 to inhibit spilling of crude oil sands from out of the separation trough during the bitumen separation process.

Figure 6A:
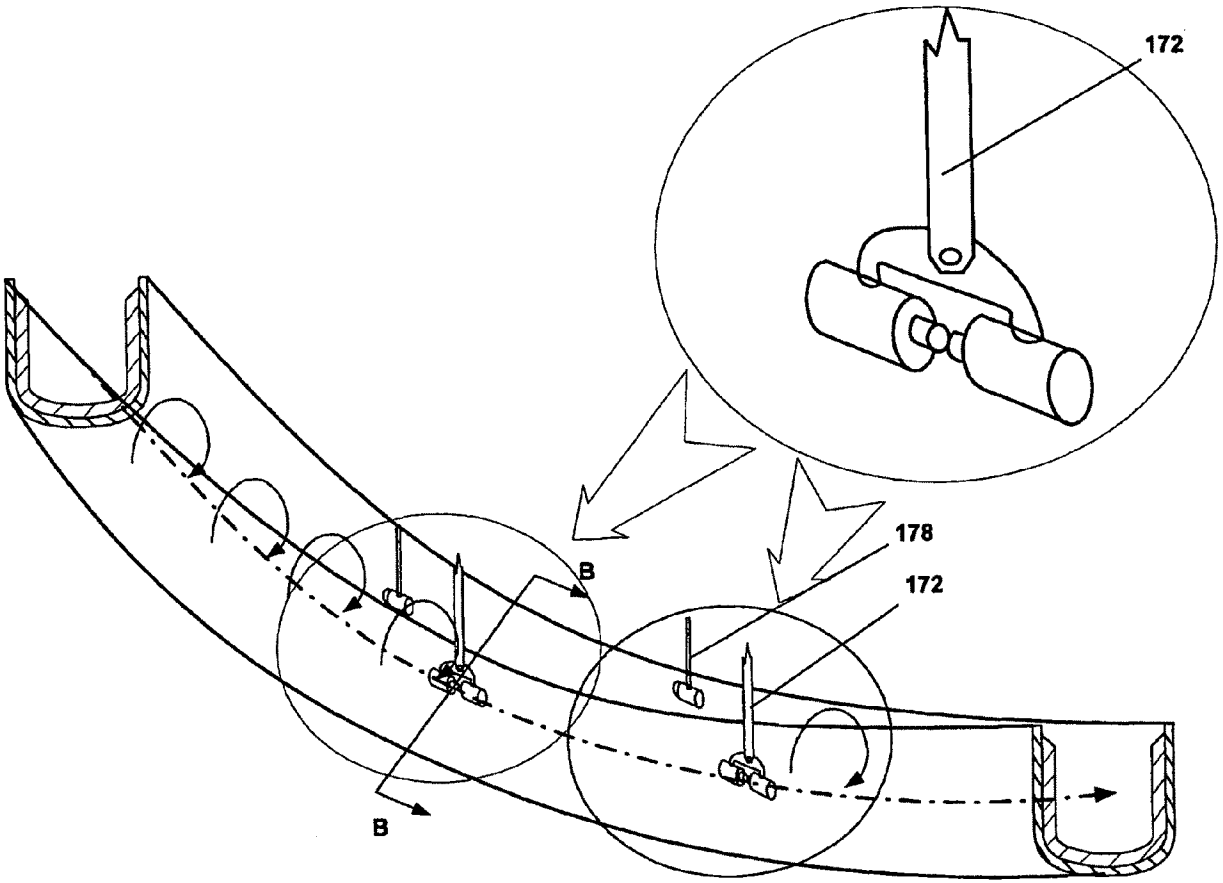
FIG. 6*a* is a perspective view of a portion of the separation trough.
Figure 6B:
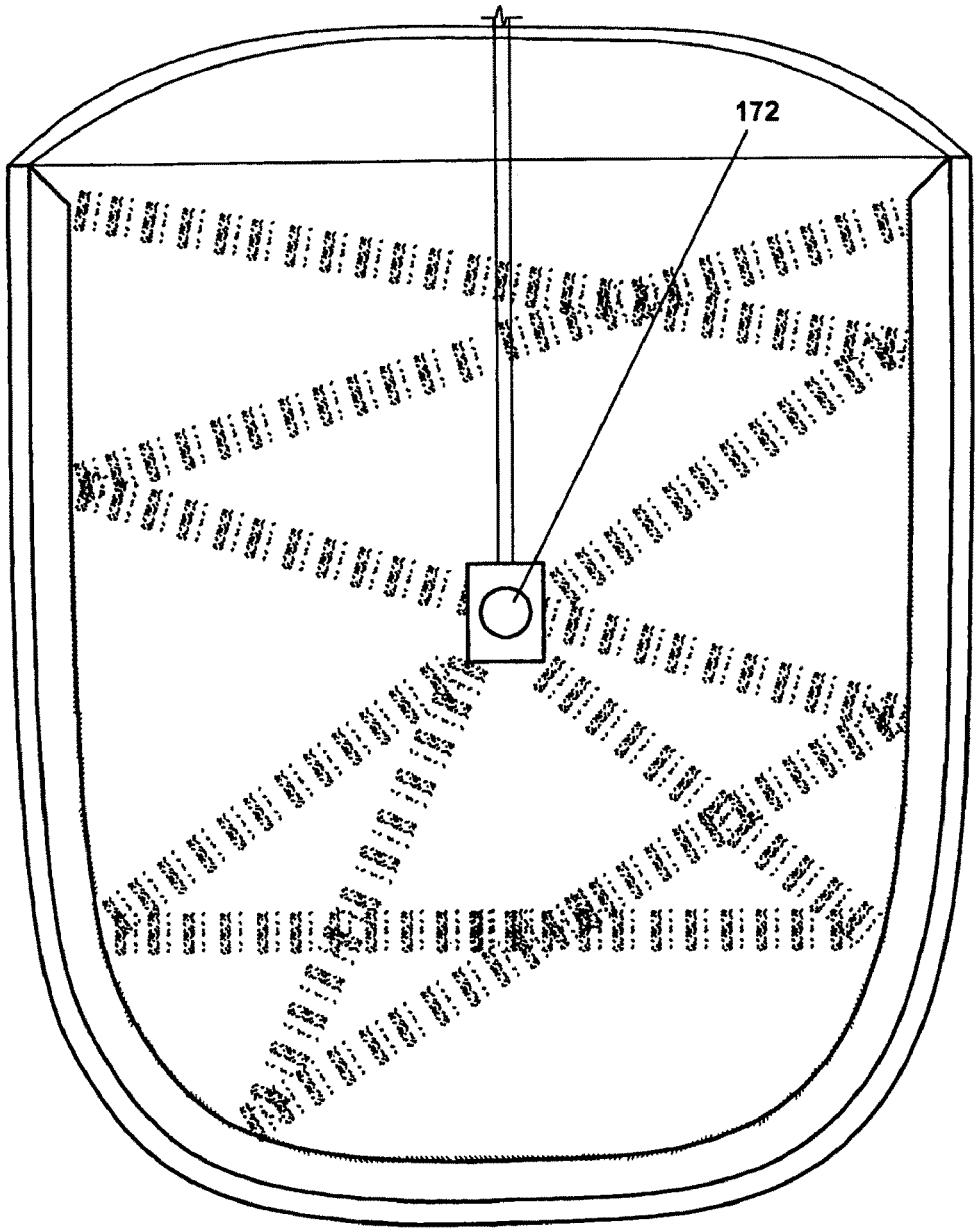
FIG. 6*b* is a cross-section view of the separation trough of FIG. 6*a* taken along line B-B FIG. 6*a;*
Figure 6C:
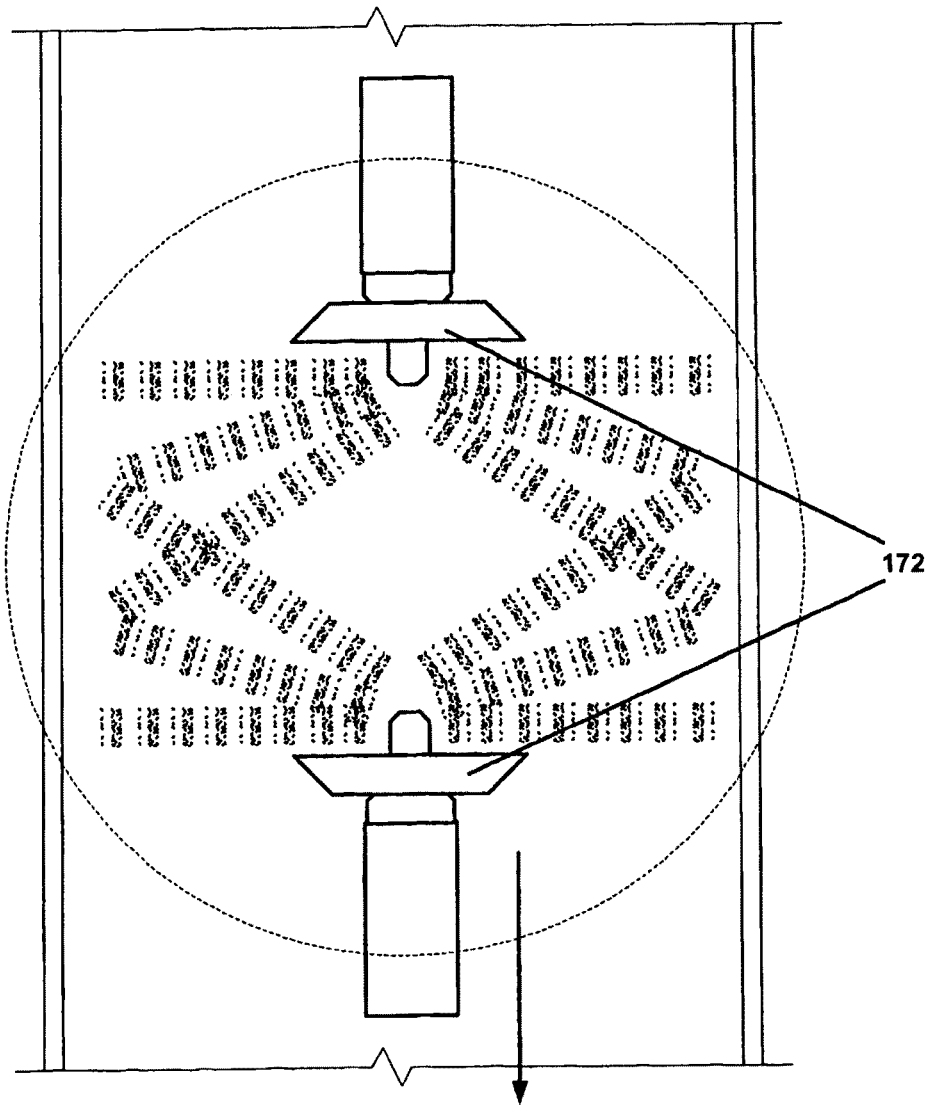
FIG. 6*c* is a top plan view of the separation trough of FIG. 6*a* at line B-B of FIG. 6*a.*

As shown in FIGS. 6*a* to 6*c*, exciters 172 are positioned within and along the channel 152 of the separation trough 142 at spaced locations. As a result, during operation, the exciters 172 are immersed in the flow of crude oil sands 120. The exciters 172 are controlled so that they vibrate at a frequency that is generally matched to the resonant frequency or natural frequency mode of vibration (or "harmonic" thereof) of the bitumen in the crude oil sands to assist in separating bitumen from the crude oil sands 120.

Figure 7A:
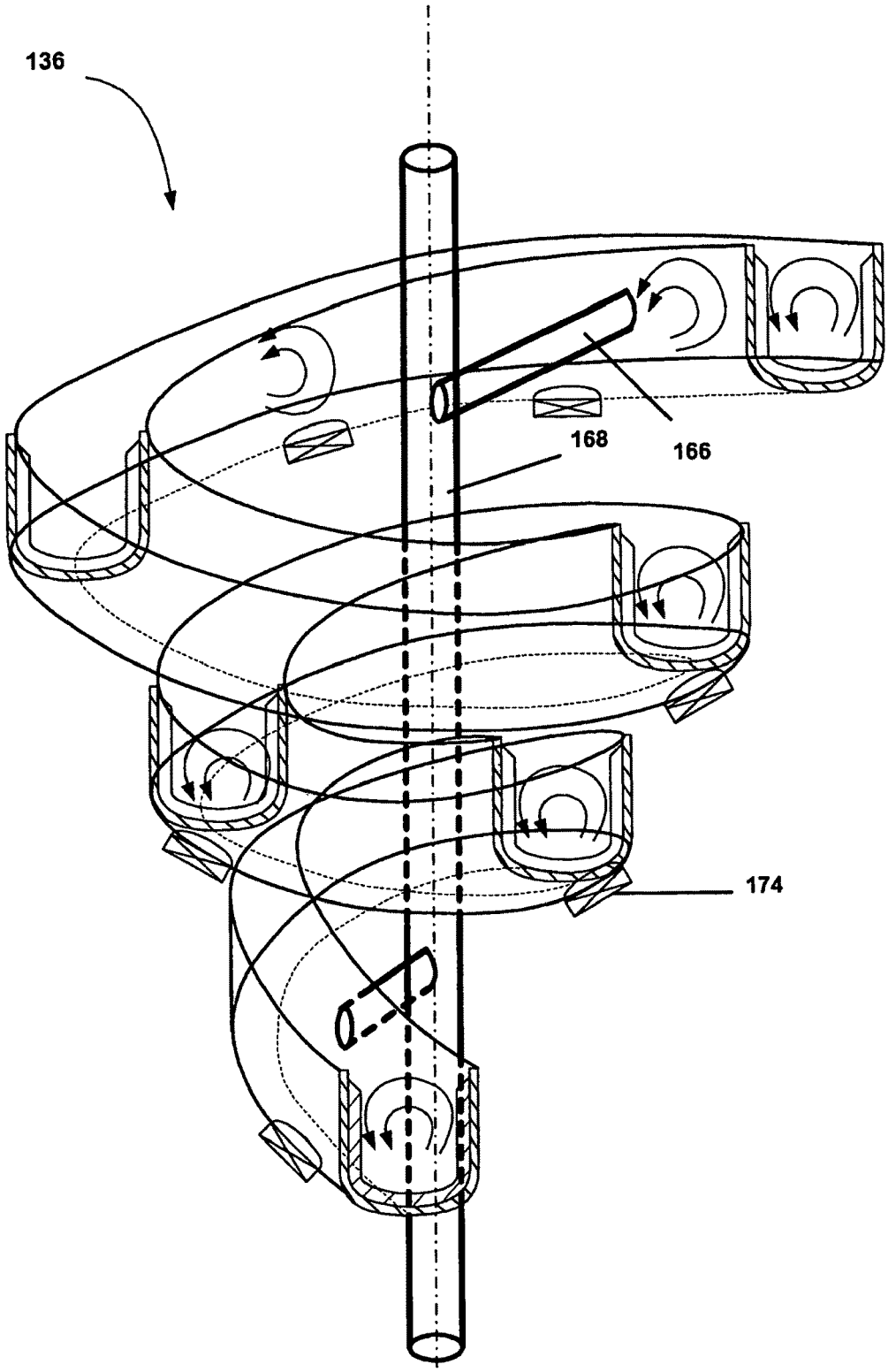
FIG. 7*a* is another side elevation view, partly in section, of the trough assembly showing torsional vibration vanes at spaced locations along the separation trough.
Figure 7B:
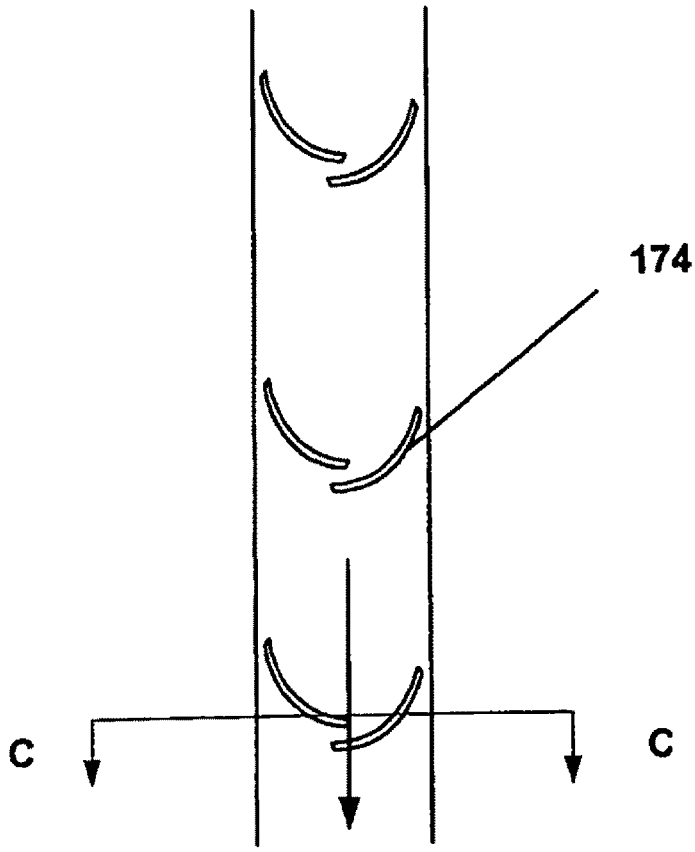
FIG. 7*b* is a top plan view of a portion of the separation trough of FIG. 7*a;*
Figure 7C:
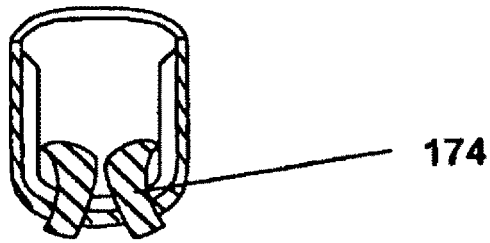
FIG. 7*c* is a cross-section view of the separation trough of FIG. 7*b* taken along line C-C.

As shown in FIGS. 7*a* to 7*c*, torsional vibration vanes 174 are placed between the exciters 172. The vibration vanes 174 are vibrated in a manner to create anti-protuberance nodules which oscillate between large negative/positive displacements. The torsional vibration vanes 174 also serve to increase the amount of shear and gravity-assisted tumbling of crude oil sands 120. Although, the torsional vibration vanes 174 are depicted in FIGS. 7*b* and 7*c* as being curved pairs and partially embedded in the separation trough 142, it will be appreciated by those skilled in the art that the vibration vanes 174 may take any suitable form that increases the amount of shear and gravity-assisted tumbling of crude oil sands 120.

Figure 8:
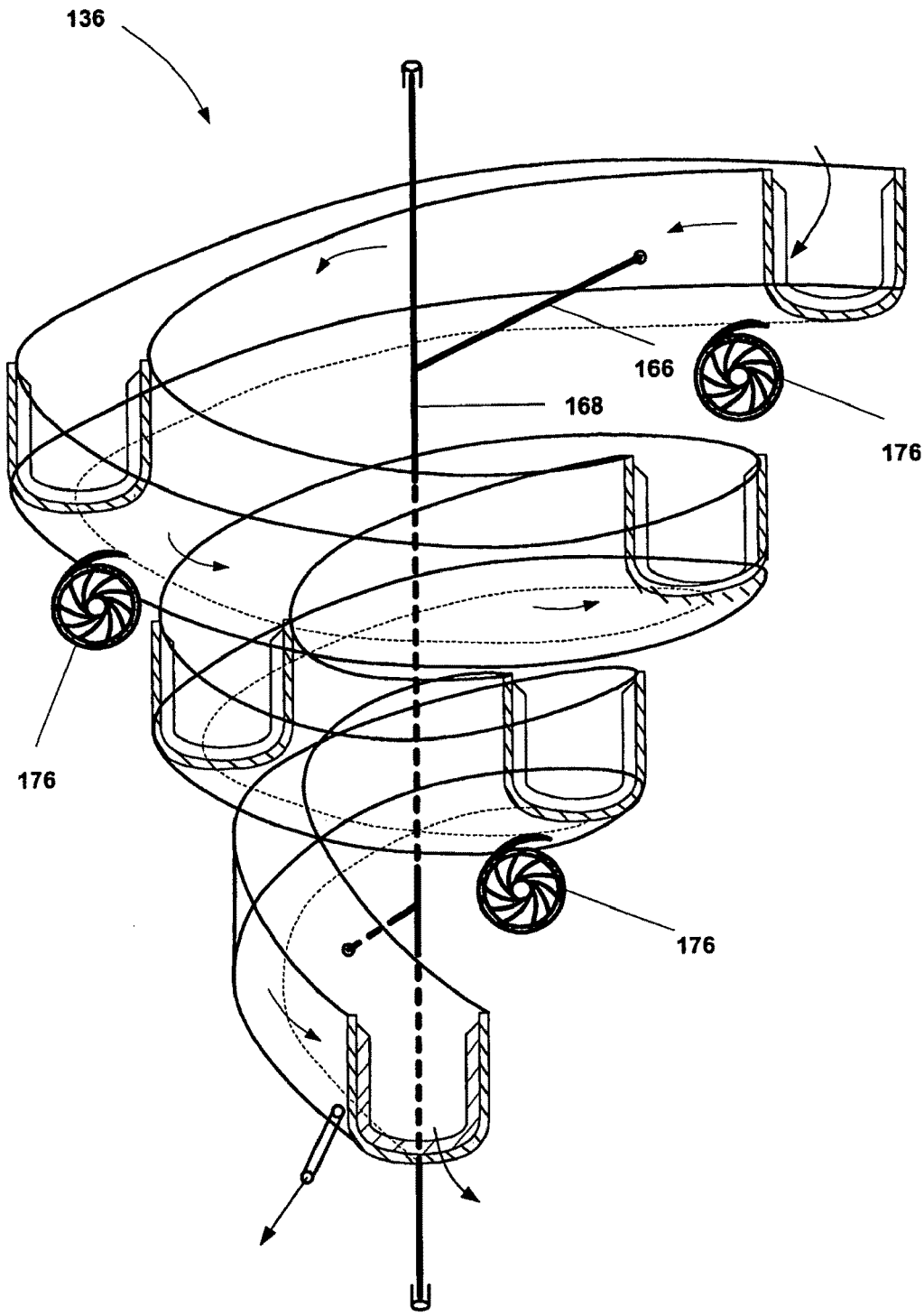
FIG. 8 is another side elevation view, partly in section, of the trough assembly showing linear vibration drives at spaced locations along the separation trough.

As shown in FIG. 8, trough assembly 136 also comprises linear vibrating drives 176 placed at spaced intervals along separation trough 142 to control the downward acceleration of the crude oil sand 120.

As described above, crude oil sands 120 are a non-homogeneous mixture and therefore, it is useful to monitor the separation process and measure a number of the physical properties of the crude oil sand 120 in order to adjust in real-time, the operating frequencies of the exciters 172, torsional vibration vanes 174 and linear vibrating drives 176. Some of these physical properties may be, but are not limited to temperature, mass, viscosity, speed of flow and depth of the crude oil sand 120 in the separation trough 142. The physical properties of liquids may be monitored and measured by various sensory arrays or detection devices well-known by those skilled in the art positioned at locations along the trough assembly.

For example, as can be seen in FIG. 6*a*, rat's tail detectors 178 for measuring speed of flow are shown. Each detector 178 is an incremental ratchet-toggling switch where the switch's rotating detent gear is attached to a rigid, plastic coated rod hanging down into the separation trough 142. The rod is spring loaded to a forward detent position corresponding to zero flow but moves by flow drag toward a rear position. In this embodiment, a rat's tail detector 178 is placed ahead of each exciter 172 to measure flow properties of the crude oil sands 120. A representative rat's tail detector 178 is made by Square D, a brand of Schneider Electric Company and other known manufacturers include Allan Bradley. The output of the detectors 178 is applied to a computer (not shown) executing "watchdog" software. The computer "watchdog" software in response to the output of the detectors 178 changes the output harmonics of the resonant frequency-imparting exciters 172, torsional vibration vanes 174 and linear vibrating drives 176.

Figure 9:
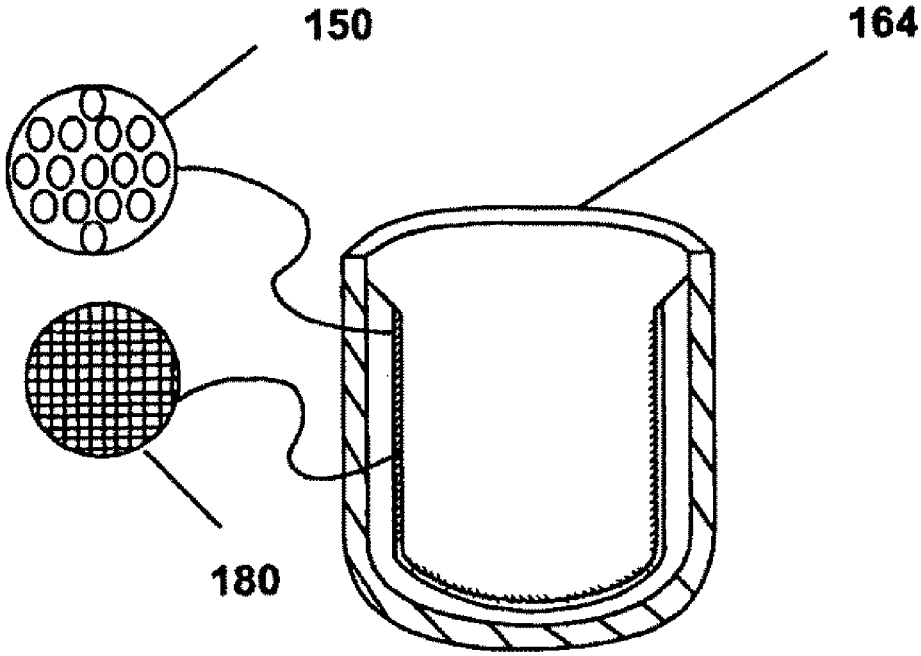
FIG. 9 is a cross-section view of a portion of the separation trough showing an anti-dampening mesh.

It will be appreciated that separation trough 142 may exert a dampening effect to the harmonics created by the various vibration-imparting devices. To substantially retain harmonic energy within separation trough 142, an anti-dampening mesh 180 is placed overtop and adjacent to mesh 150 as shown in FIG. 9.

The exciters 172 and torsional vibration vanes 174 placed in the path of flow of crude oil sands 120 in combination with the linear vibrating drives 176 create zones where the resultant waves (or their respective $1^{st}$, $2^{nd}$, and $3^{rd}$ harmonics etc . . . ) meet, resulting in pressure-pulse-wave incursion as shown in FIGS. 6*b* and 6*c*. The pressure-pulse-wave incursion causes interference that is destructive and useful in separating bitumen from crude oil sands 120.

Figure 10:
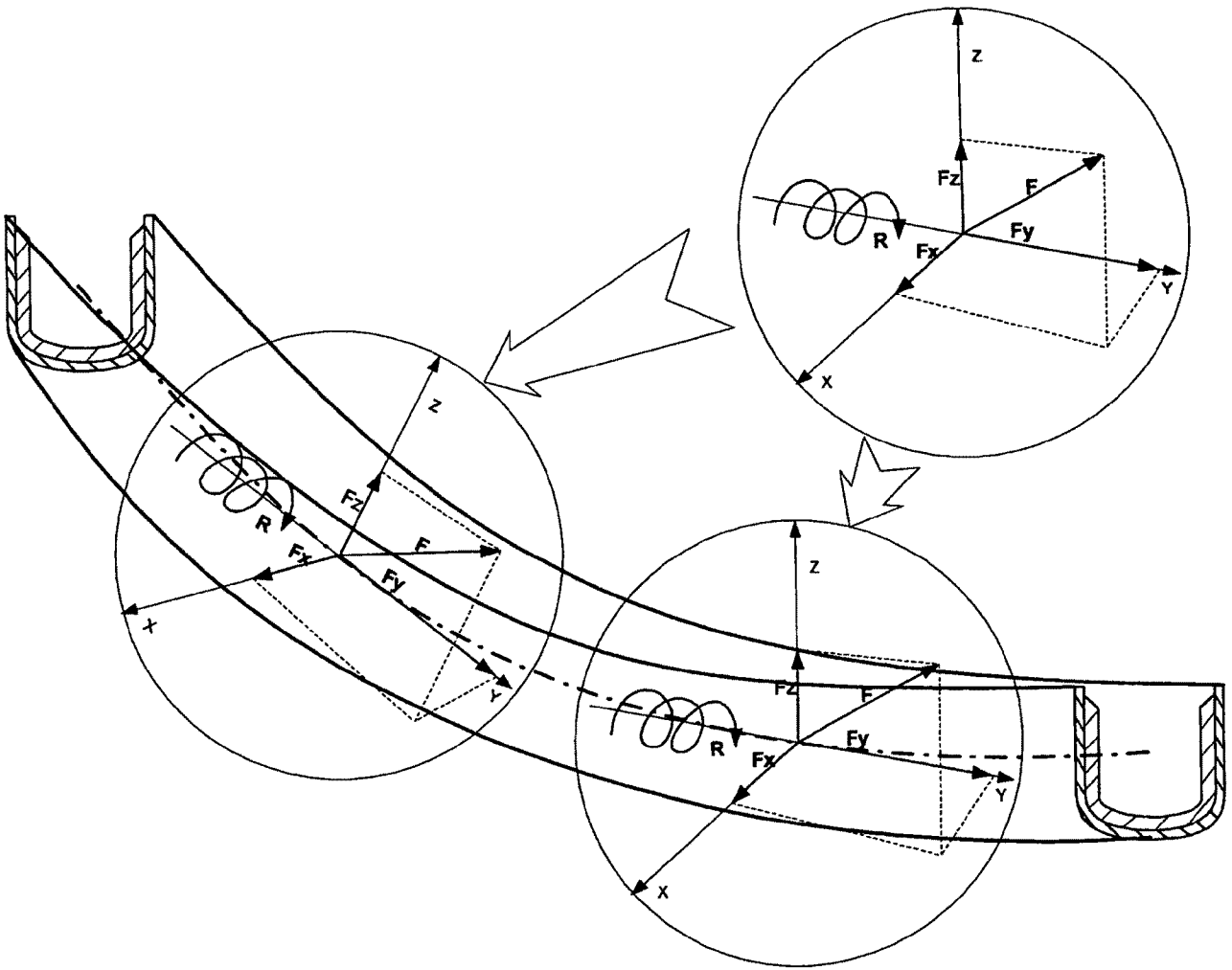
FIG. 10 is a perspective view of a portion of the separation trough showing flow direction vectors.

As shown in FIG. 10, the pressure-pulse-wave incursion is expected to result from a combination of force vectors where vector y=about 3 Hz to about 240 Hz; R, is torsional force=about 175 Hz to about 750 Hz; vector x=about 500 Hz to about 1.1 KHz; vector z=about 3 KHz to about 5.5 KHz; and resonant frequency f=1.75 GHz to about 2.2 GHZ. The collective resonant frequencies may range from about 25 Hz to about 2.2 GHz, however, it will be appreciated by one skilled in the art would that the most suitable range of resonant frequencies will depend on variables such as, but not limited to the amount, temperature, pressure, composition and other physical properties of crude oil sands 120.

Before operating the dredge, tarn 112 is initially excavated using existing excavation methods to form a pit and the pit is filled with water. Tarn 112 may alternatively be filled with brackish water in the winter months to prevent freezing of tarn 112. Sulphur may be added to the water or brackish water to assist in the lubrication of submersed moving dredge parts. Once filled, the dredge 110 is floated into tarn 112. Dredge 110 progresses on its own power or is moved by other means to the leading edge of tarn 112. Dredge 110 may be guided using steering spuds 182, however, one skilled in the art will appreciate that the dredge 110 may be steered by any known means of steering. The speed of dredge 110 is dependent upon, among other things, temperature and may be in the order of about 10-25 feet/24 hour day.

Once the dredge 110 is properly positioned within the tarn 112, the dredge cutting head 116 is actuated and begins its oscillating motion. Crude oil sands 120 that are excavated using the dredge head 116 are delivered to the first churn 126 where the crude oil sands 120 are dehumidified with $CO_2$ and/or infrared to begin the process of bitumen separation.

From the first churn 126, crude oil sands 120 are then fed into the second churn 130 containing various extraction and/or processing agents. The extraction agents may be selected from the group consisting of sodium hydroxide, boric acid, nitric oxide and sulphur dioxides. From the second churn 130, the pre-treated crude oil sands are directed into distribution hopper 124. One skilled in the art will understand that there may be as many or as few churns as required to make crude oil sands 120 into a consistency suitable for the separation of bitumen. Distribution hopper 124 divides the crude oil sands 120 and conveys them to the distribution troughs 132, each of which is in operative communication with one of the separation apparatuses 134.

In each separation apparatus 134, to separate bitumen from crude oil sands 120, the exciters 172, vibration vanes 174 and linear vibrating drives 176 of the first trough assembly 136 vibrate and control the flow of crude oil sands to separate bitumen from crude oil sands 120. By matching the vibration generally to the resonant frequency of the bitumen in the crude oil sands, the separation of the bitumen begins resulting in the loosened bitumen flowing through the mesh 180 and mesh screen 150 and collecting in bitumen collection channel 154. This separation is aided further by the cross-shear experienced by crude oil sands 120 as they tumble in resemblance to a rolling avalanche to tail portion 156 of first trough assembly 136. The vibrational vanes 174 also serve to increase the amount of shear experienced by crude oil sands 120 as they move downward through trough assembly 136. The separated bitumen exits the first trough assembly 136 via bitumen discharge outlet 158 of first trough assembly 136.

Crude oil sands 120 exiting the first trough assembly 136 are delivered to the second trough assembly 136 in the series. The crude oil sands are then subjected to a second round of separation. In this round of separation, the crude oil sands 120 are treated with various extraction agents and/or processing agents. The extraction agent may be NaOH which acts to crack crude oil sands 120 by breaking the long chain hydrocarbons into smaller chain hydrocarbons. One skilled in the art would readily understand that any other suitable cracking agents may also be used. The exciters 172, vibrational vanes 174 and linear vibrating drives 176 of the second trough assembly similarly vibrate and control crude oil sand flow in a manner to separate further bitumen from crude oil sands. The separated bitumen is collected by the bitumen collecting channel 154 and delivered to the bitumen discharge outlet 158. The crude oil sands exiting the second trough assembly are then delivered to the last trough assembly in the series. Crude oil sands 120 are then subjected to the third round of separation. In particular, the crude oil sands 120 are treated with additional extraction agents and/or processing agents, such as for example thinning agents (e.g. naphtha). The exciters 172, vibrational vanes 174 and linear vibrating drives 176 vibrate and control the flow of crude oil sand in a manner to separate bitumen from crude oil sands.

As mentioned above, crude oil sands contain a number of different media, such as for example clay, sand and viscid bitumen-lacker oils. Clay is obtained from the weathering of Feldspar, a very common form a rock/clay and has the chemical formula $Al_2O_3.2SiO_2.2H_2O$. To aid in the harmonic separation of bitumen from clay in crude oil sands 120, extraction agents including, but not limited to, sodium hydroxide and liquid $CO_2$, may be added to help create shearing causing additional dispersion and flocculation. Sand is finely divided rock comprising granular particles ranging usually from 0.004 mm to 0.062 mm. The most common constituents of sand is silica or silicon dioxide in the form of quartz with considerable Feldspar content.

Figure 11:
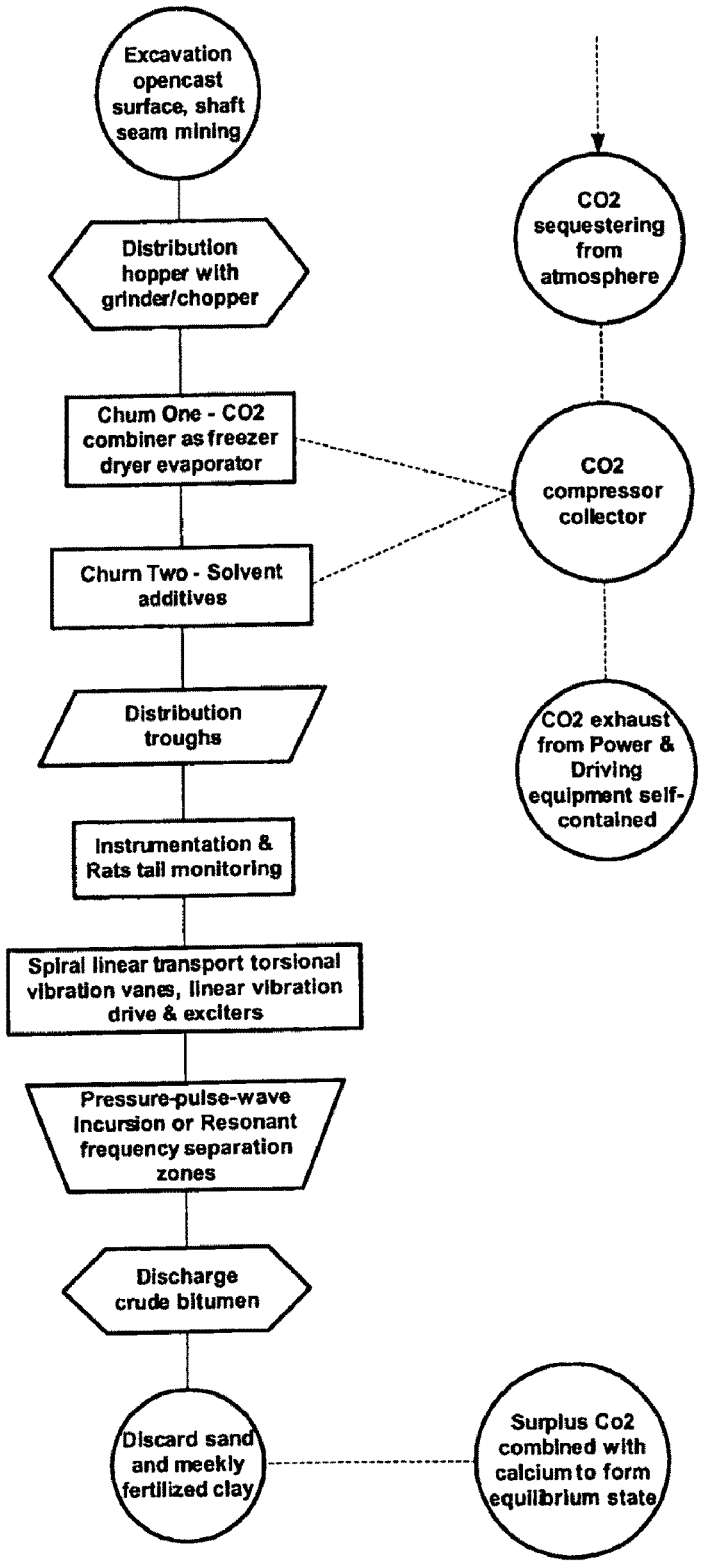
FIG. 11 is a flowchart showing the steps performed during separation of bitumen from crude oil sands.

Bitumen that is collected by the bitumen collection channels 154 of the trough assemblies is stored on board the dredge 110 in the bitumen storage vessels (not shown). The stored bitumen is then ready for delivery to an off-site extraction facility for further processing. The de-oiled media that is discharged from the dry filtrate discharge outlet 160 of the last trough assembly of each separation apparatus is removed from dredge 110 by the dragline 186 to backfill the tarn 112 as the dredge 110 moves in the forward direction. FIG. 11 is a flowchart illustrating generally the steps described above.

One skilled in the art would understand that during bitumen extraction, any combination of extraction agents and/or processing agents may be added to any one or all of trough assemblies 136 to assist in extraction of the bitumen from crude oil sands 120. The substantially de-oiled media may be removed at the termination of each round of the bitumen separation process to further concentrate the remaining oil-laden sand. Any substantially de-oiled media that serves additional commercial purposes may be harvested during the bitumen separation process. An example would be Kaolin clay having the composition of $Al_2Si_2O_5(OH)_4$. Kaolin clay (Kaolinite) obtained from crude oil sands 120 has commercial importance in the pharmaceutical; cosmetic; and the ceramics industries. One skilled in art would readily understand how Kaolin clay might be harvested during the bitumen separation process. For example, the lighter Kaolin clay may be skimmed off the surface of the crude oil sands during the process of bitumen separation.

Although each trough assembly is described as comprising exciters 172, vibrating vanes 174 and linear vibrating devices 176, the trough assemblies 136 may comprise a subset of these resonant-frequency imparting devices. Also, if desired, the trough assemblies in each separation apparatus 134 may comprise different combinations of resonant-frequency imparting devices. Of course, different vibration devices or mechanisms to impart vibration to crude oil sands in the separation troughs 142 of the trough assemblies can be employed. For example, turning to FIG. 12 and alternative trough assembly 136 is shown. In this embodiment, the support stem 168 is mechanically coupled to a central stem vibrator (not shown). The central stem vibrator can be any known device which causes axial vibration of the central support stem 168 resulting in causing vibration of trough assembly 136 and thus, urging the crude oil sands 120 down trough assembly 136. Trough assembly 136 is also provided with a number of resonant frequency-imparting devices 170 fixed to the outside wall of the separation trough. Resonant frequency-imparting devices 170 produce in vibratory to assist in separating bitumen from the crude oil sands 120. The resultant effect is that the crude oil sands traveling down the trough assembly 136 experience dual vibrating harmonic interference or beat frequency in a heterodyne fashion. In this embodiment, each trough assembly in the series produces vibration at a different frequency that substantially matches the natural frequency mode of vibration of a different particular media or consistent of the crude oil sands 120.

Figure 12:
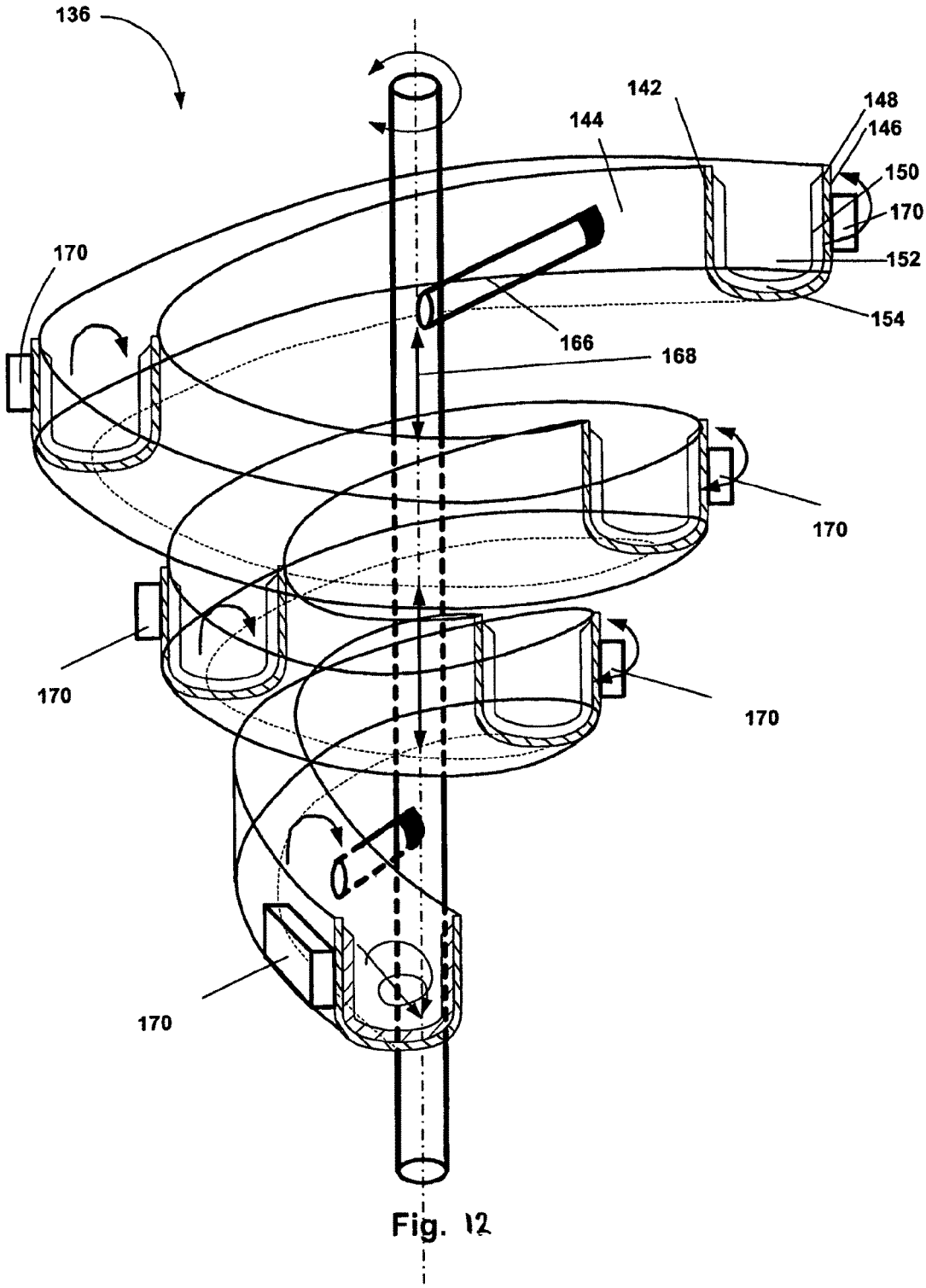
FIG. 12 is a side elevation view, partly in section of an alternative trough assembly.

In the embodiment of FIG. 12, the natural frequency mode of vibration is calculated using the following formula. Treating the trough assembly as a flexible-mass system to which an external force $F_o \cos(\omega t)$ is applied, where $F_o$ and $\omega$ are constants, the equation of motion is then $$my''+\gamma y'+ky=F_o\cos(\omega t)$$

$$y=\mathrm{Re}\,z$$

with $$mz''+\gamma z'+kz=F_o\exp(\omega t)$$

a trial solution, $$z=B\exp(i\omega t)$$

The roots of the characteristic equation will all have negative real parts. One gets, $$B=\frac{F_o}{-m\omega^2+i\gamma\omega+k}=\frac{F_o}{m(\omega_o^2-\omega^2)+i\gamma\omega}$$

We want to write this in a polar representation $$B=Re\,xp(-i\delta)$$

where $$R>0.$$

Thus $$R = |B| = \frac{F_o}{|m(\omega_o^2 - \omega^2) + i\gamma\omega|} = \frac{F_o}{\Delta}$$

where $$\Delta=\sqrt{m^2(\omega_o^2-\omega^2)^2+\gamma^2\omega^2}$$

$$\cos\delta=m(\omega_o^2-\omega^2)/\Delta$$

$$\sin\delta=\gamma\omega/\Delta$$

where $$\omega_o=\sqrt{k/m}$$

where m is the system mass k is the system stiffness (variables)

γ is the system damping (variables)

when the 'R' amount is controlled and the range is 0-3 mm, a value of about 247 Hz is obtained for ω.

It will be understood that other methods to calculate the range of resonant frequencies (or natural frequency mode of vibration) of media in crude oil sands may be readily conceived by one skilled in the art.

Figure 13A:
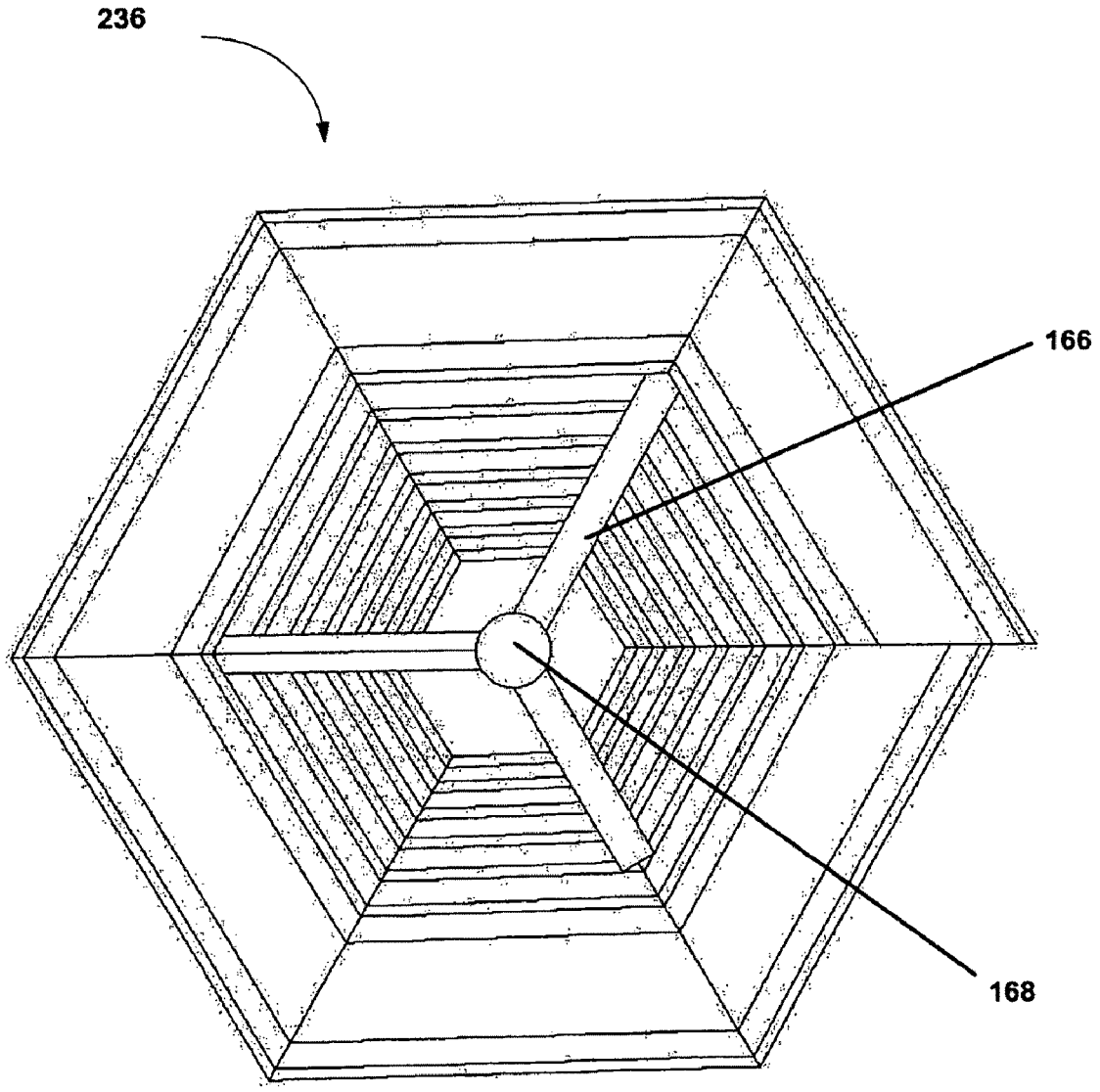
FIG. 13*a* is a top plan view of another embodiment of a trough assembly comprising a faceted spiral separation trough.
Figure 13B:
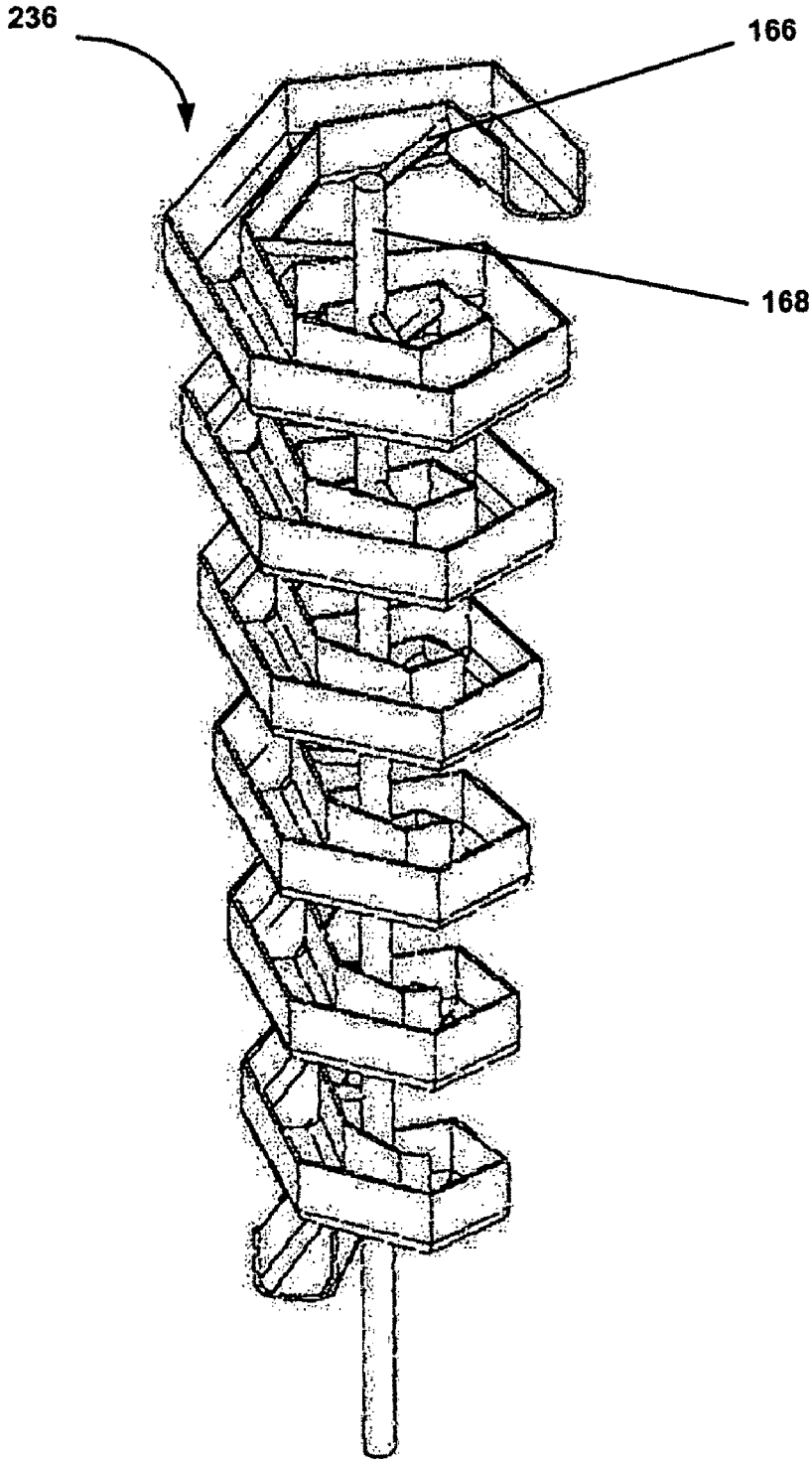
FIG. 13*b* is a perspective view of the trough assembly of FIG. 13*a;*

Although, it has been shown that trough assembly 136 has a downwardly depending circular, smooth spiral configuration, it will be readily apparent that the trough assembly 136 need not have a substantially smooth shape. As can be seen in FIGS. 13*a* and 13*b*, trough assembly 236 may also have a substantially faceted spiral configuration. Furthermore, one skilled in the art will understand that trough assembly 136 need not be a downwardly depending spiral having an inverse slope. Rather, the trough assembly 136 may have a helical shape or may rest in a substantially horizontal plane so long as vibration can be applied to crude oil sands to harmonically separate the bitumen from the crude oil sands 120.

In cross-section, the separation trough 142 of each trough assembly 136 has been shown to be substantially U-shaped, however, one skilled in the art will understand that trough 142 need not have a U-shape and that it may have a V-shape or any shape that can suitably contain crude oil sands 120. Trough 142 may also be made to have an internal diameter (d) that decreases from head portion 144 to tail portion 156 to compensate for any decreases in the volume of crude oil sands 120 as bitumen is removed during the harmonic separation process.

Mesh screen 150 can be an inconel or cobalt wire mesh or similar material and anti-dampening mesh 180 can be made of nylon. One skilled in the art will understand that mesh screen 150 and anti-dampening mesh 180 may be made of any material that is durable and can withstand large vibrational and frictional forces and the tolerance pitch dot size can range from about 0.001 to 0.02 inches.

Figure 14A:
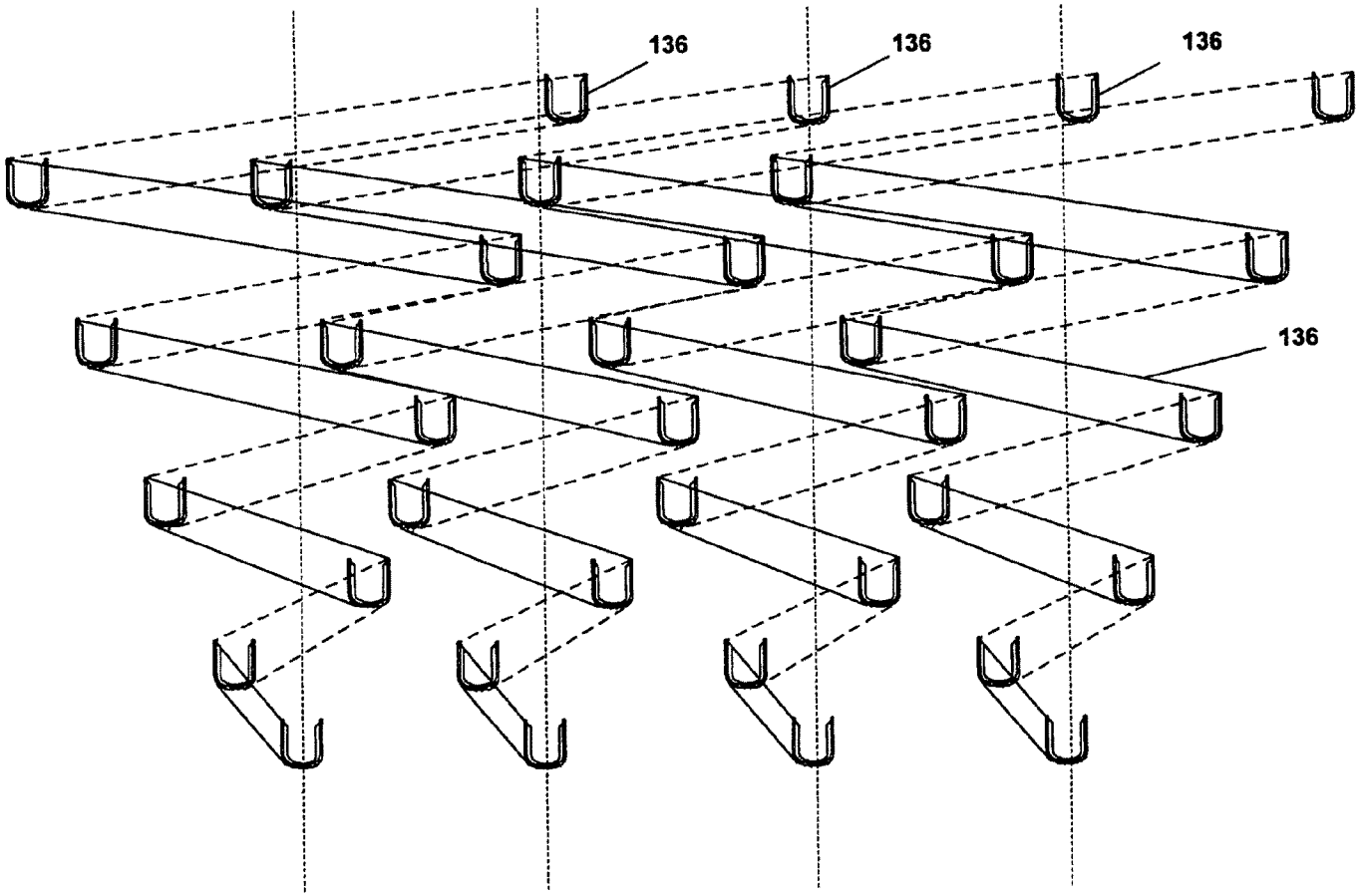
FIG. 14*a* is a side elevation view of a plurality of nested trough assemblies.
Figure 14B:
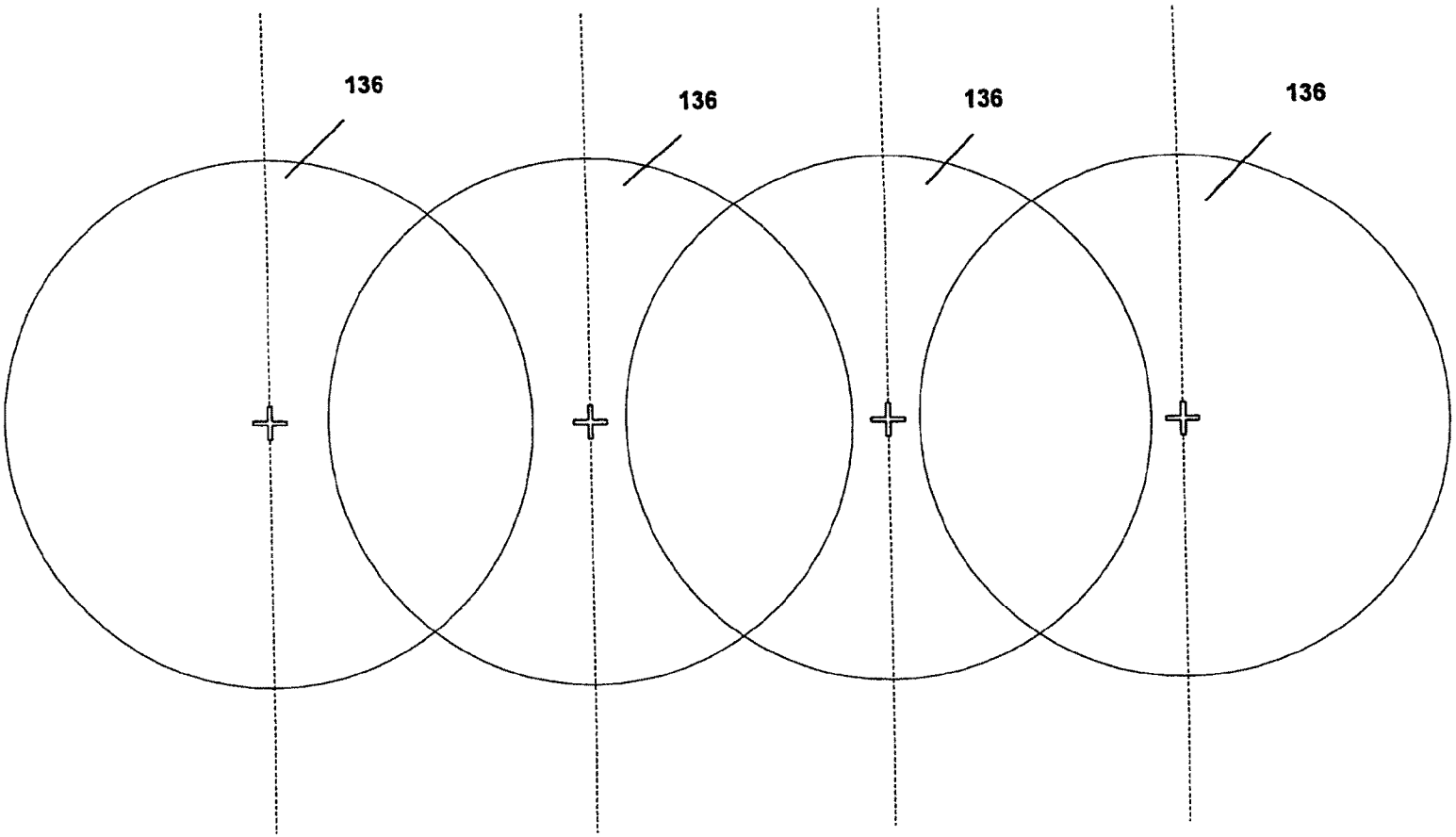
FIG. 14*b* is a top plan view of the nested trough assemblies of FIG. 14*a;*

Shown in FIGS. 14*a* and 14*b* is another embodiment of separation apparatuses comprising trough assemblies 136 arranged in a compact inter-leafed configuration designed to maximize the amount of available area on dredge 110. It will also be readily appreciated that there may be fewer or greater than three (3) trough assemblies 136 in a vertical series in any given separation apparatus 134 and that the number of loops in the trough assemblies 136 may vary.

Figure 15:
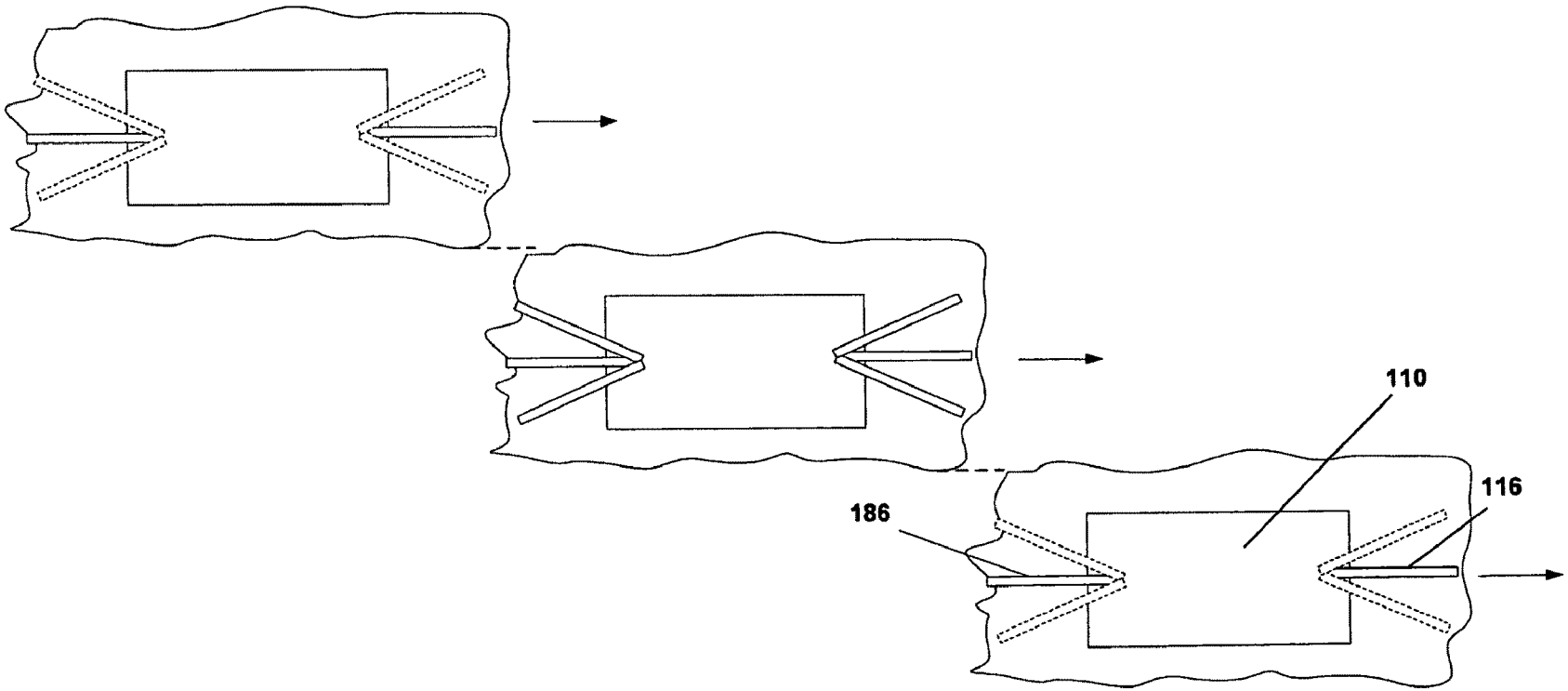
FIG. 15 is a top plan view showing multiple recovery dredges lined up astern.

As shown in FIG. 15, a series of identical dredges 110 lined up astern to more efficiently excavate a larger area is depicted. In this embodiment, the cutting heads 116 and draglines 186 of the dredges are swingable between angles of repose shown by the broken lines, however, one skilled in the art would readily understand that dredge head 116 and dragline 186 may also be fixed. The gantries 118 allow the depths of the cutting heads to be adjusted to permit dredging at considerable depths below the surface. For example, dredging depths around 80 meters below the surface are achievable.

As mentioned above, the bitumen in bitumen storage vessels on-board dredge 110 is ready for delivery to an off-site extraction facility for further processing. If desired an umbilical transfer line (not shown) may be provided that sits on a gantry mounted on the deck 113 and that protrudes perpendicular from the centerline of travel of the dredge 110 for discharging the bitumen to wheeled tankers moving alongside the tarn, or to a looped pipeline for pick-up.

It will be appreciated that since dredge 110 is an enclosed system, any extraction and/or processing agents that are used during the bitumen separation process can also be reused by employing on-board extraction agent recyclers (not shown). One skilled in the art will readily understand that on-board extraction agent recyclers can comprise standard chiller/centrifuge and recovery equipment. Furthermore, the source of the $CO_2$ used during the crude oil sand 120 dehumidification process, may be from $CO_2$ sequestered from the atmosphere using air carbon capture and/or from exhaust gases produced by ancillary mechanical equipment (e.g. diesel-electric generators, Ward Leonard sets and engines etc . . . ) and combined in $CO_2$ compressor collectors. Any excess $CO_2$ may be combined with calcium (to form calcium carbonate or otherwise known as talc) and released into the tailings to act as a meek stabilizing fertilizer.

Dredge 110 may also be provided with water pumping systems to pump water to-and-from tarn 112 for use with operational equipment as well as water clarifying systems. It will be appreciated by one of skill in the art that tarn 112 may contain tramp oil, which is residue oil floating on the surface of tarn 112. The tramp oil may be collected by skimming off the tramp oil from the surface of tarn 112 and added to an oil collection vessel on board the dredge 110. Collected tramp oil may be processed and refined using known methods to one of skill in the art. Water may be pumped into the dredge 110 from below the surface of tramp oil present in tarn 112. The water that is pumped on board may be used during the crude oil sand excavating process as a high pressure cutting tool 184 as shown in FIGS. 1 and 2. Water forced out of cutting tool 184 at extremely high pressures erodes and aids the breaking up of the crude oil sands 120. Water pumped into the dredge 110 may also be used as a partial means of propulsion and steering for dredge 110. The dredge 110 may also be provided with water cooling systems (not shown) to cool the cutting head 116 and any onboard pumps, compressors, diesel-electric generators and/or electric motors and other ancillary devices (not shown). The dredge 110 may also be provided with water heating systems (not shown) to heat the water for use during the bitumen separation process.

Figure 16:
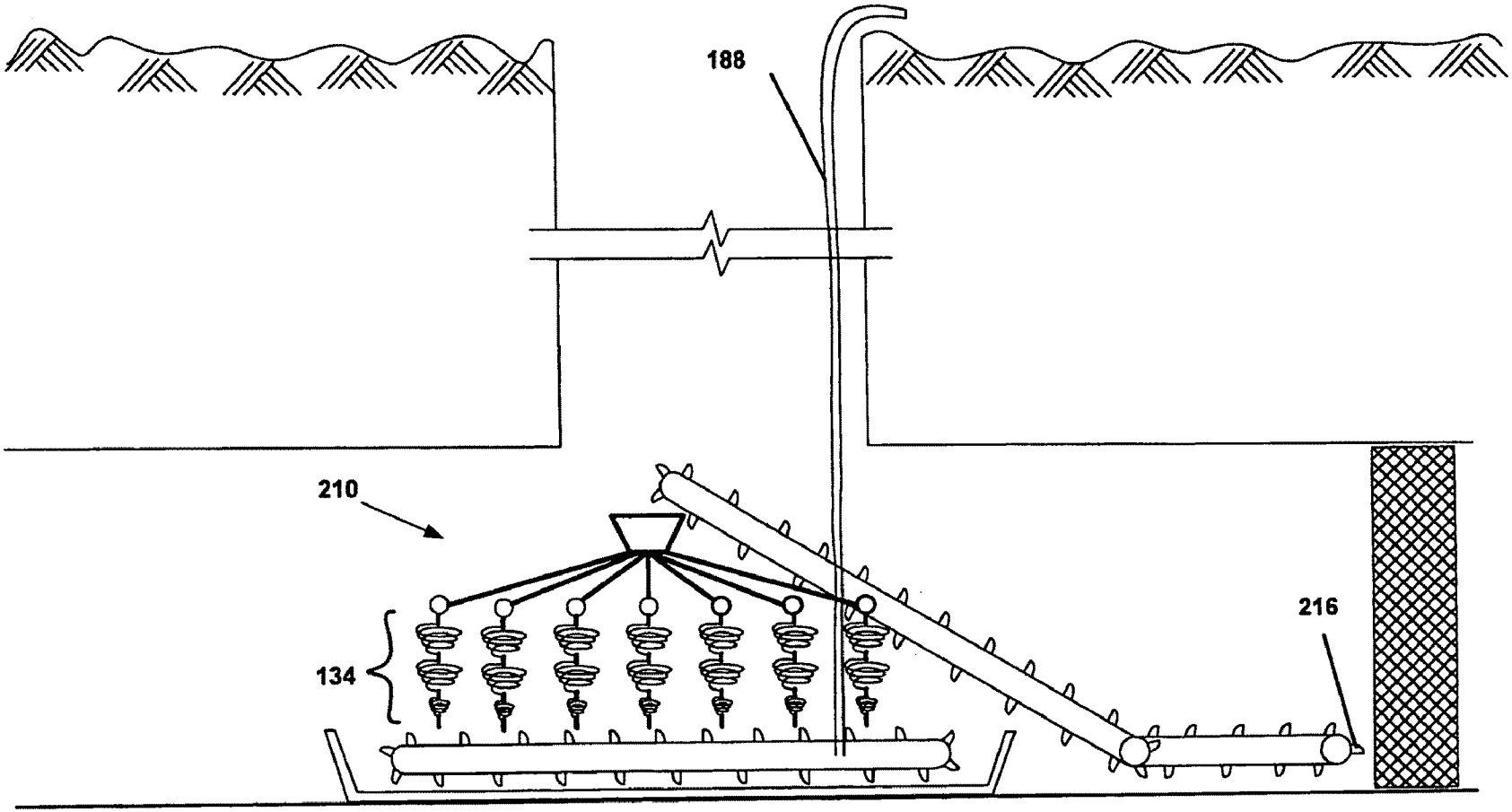
FIG. 16 is a side elevation view of another embodiment of a recovery dredge for use in deep oil sand mining.
Figure 17:
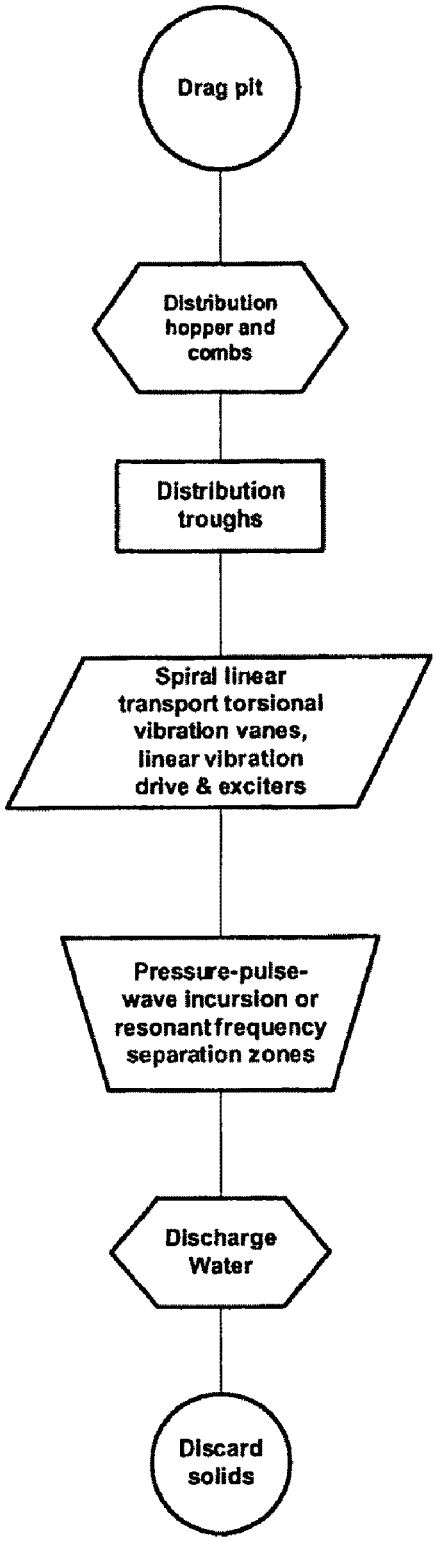
FIG. 17 is a flowchart showing the steps performed during separation of water from sewage.

Turning now to FIG. 16, a subterranean harvester 210 for use in deep mining processes is shown. As can be seen, harvester 210 is adapted for use in underground crude oil sand mining operations. The subterranean harvester 210 is lowered below ground via mining collection shafts and employs a tunnel boring head 216 and a suitable dragline. Crude oil sands excavated using boring head 216 are processed by a crude oil sand processing apparatus similar to that described above. The separated bitumen is then removed from the mine using conventional means such as for example, a transfer line 188.

It will be readily appreciated that separation apparatus 134 may be considered an independent platform and thus, the separation apparatus 134 may be utilized in different applications, and may be moveable from one system to another system. In other words, separation apparatus 134 may be moved, for example, from mobile dredge 110 to subterranean harvester 210 and visa versa.

In summary, a novel self-contained mobile dredge that employs harmonic and chemical technique to separate bitumen from crude oil sands at the site of the tar/crude oil sand deposit is described. The mobile dredge obviates the need for shovels for the excavation process and trucks to deliver the crude oil sands to an offsite processing facility and to return the partially de-oiled sand residue to a tailings location.

The mobile dredge is a significant advancement over current systems for the extraction of bitumen from crude oil sands because the mobile dredge obviates the need for expensive heavy excavation machinery and hauling systems comprising trucks, draglines, hydro-transport lines and pipelines. Also, being a self-contained system, the mobile dredge system is extremely energy efficient because it permits the recycling of the numerous extraction and/or processing agents employed during the bitumen extraction process. The mobile dredge also provides for the harvesting and collection of commercially useful particulate matter or media in crude oil sands. Furthermore, the self-contained mobile dredge is ecologically conscious because it significantly avoids the need to produce separate tailings ponds and reduces greenhouse gas.

Figure 18:
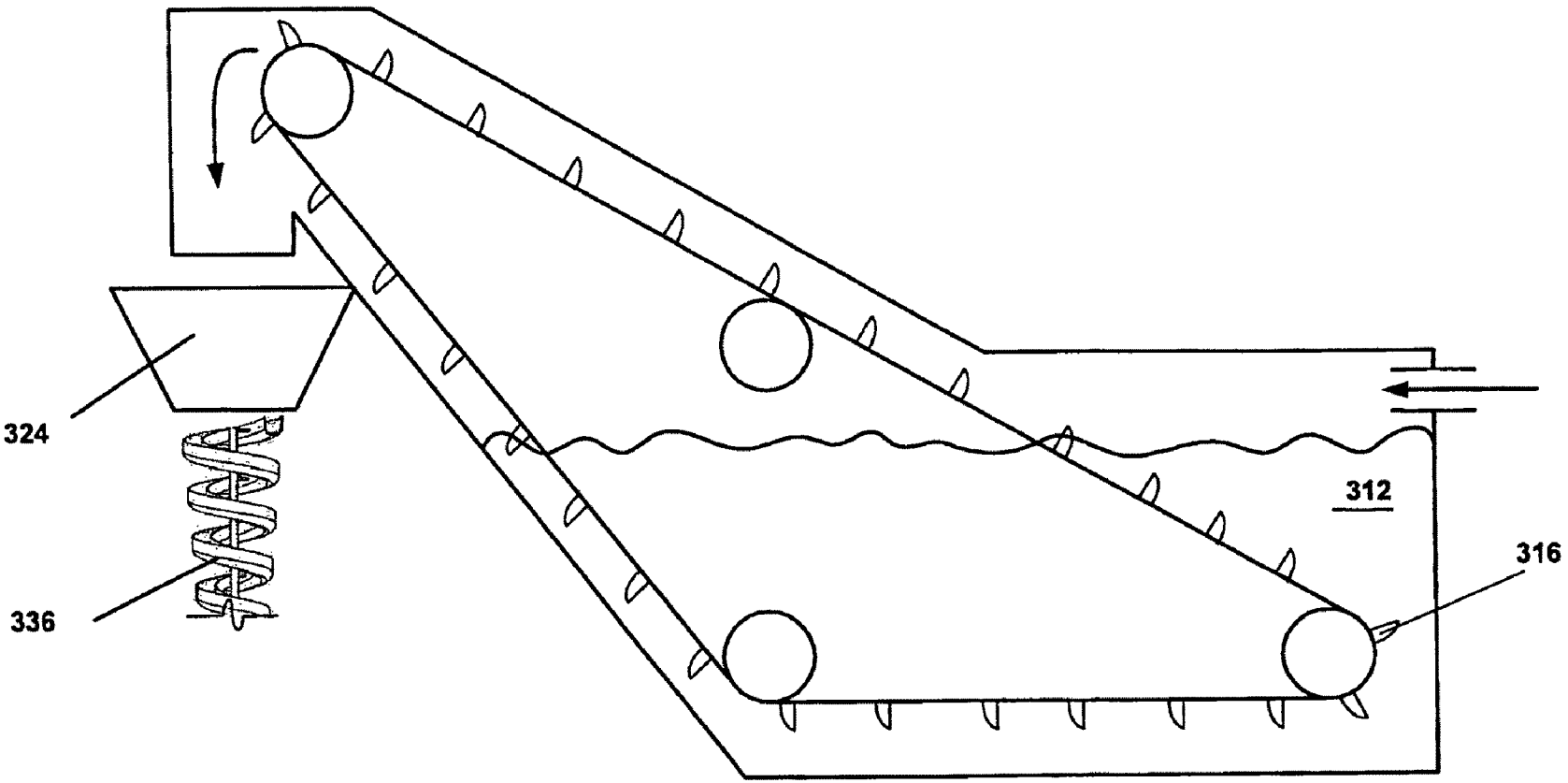
FIG. 18 is a side elevation view of a system for separating water from sewage.

It will be readily apparent that the method and the separation apparatus for separating bitumen from crude oil sands may be used in the separation of a liquid from other colloidal mixtures. For instance, water may be separated from colloidal solutions, such as for example, the de-watering of sewage, dairy products, paints, adhesives, latex rubber and biological fluids such as blood plasma. For example, water may be separated from colloidal solutions such as sewage in accordance with the method as outlined in FIG. 17. As can be seen in FIG. 18, sewage from a drag pit 312 in need of de-watering is collected by a drag chain 316 and via a distribution hopper 324 is placed on a single trough assembly 336 similar to that described above with reference to FIGS. 4 to 10.

The above-described embodiments are intended to be examples and alterations and modifications may be effected thereto, by those of skill in the art, without departing from the spirit and scope of the invention as defined by the claims appended hereto.

What is claimed is:

1. A method for separating bitumen from crude oil sands comprising:

transporting the crude oil sands downwardly along at least one generally spiral path;

during downward transportion of the crude oil sands along said at least one generally spiral path, subjecting the crude oil sands to vibration having linear and torsional components, the vibration creating zones at spaced locations along the at least one generally spiral path where vibrational waves meet resulting in pressure pulse wave incursion, the pressure pulse wave incursion creating destructive vibrational wave interference at the zones that causes bitumen to separate from crude oil sands; and filtering the separated bitumen from said crude oil sands.

2. The method of claim 1 wherein the vibration has a frequency that is generally matched to at least one constituent of said crude oil sands.

3. The method of claim 2 wherein said subjecting comprises:

subjecting the crude oil sands to vibration at different frequencies along the at least one generally spiral path in series, each vibrational frequency being matched to a different constituent of said crude oil sands.

4. The method of claim 3 wherein the crude oil sands are subjected to vibration at least three different frequencies in series.

5. The method of claim 4 further comprising:

monitoring changes in the physical properties of said crude oil sands; and adjusting the vibration based on changes in the physical properties of said crude oil sands.

6. The method of claim 2 further comprising:

pre-treating said crude oil sands prior to said subjecting.

7. The method of claim 6 wherein said pretreating comprises dehumidifying said crude oil sands.

8. The method of claim 7 wherein said pre-treating further comprises treating said crude oil sands with at least one of extraction and processing agents.

9. The method of claim 1 wherein said subjecting comprises immersing vibration sources into said crude oil sands at spaced locations along said at least one generally spiral path.

10. The method of claim 9 wherein different vibration sources are immersed into said crude oil sands at spaced locations along said at least one generally spiral path.

11. The method of claim 1 further comprising, prior to said transporting, forming a tarn in proximity to a crude oil sand deposit;

positioning a dredge in said tarn; and excavating said crude oil sands with said dredge.

12. The method of claim 11 further comprising:

monitoring changes in the physical properties of said crude oil sands; and adjusting the vibration based on changes in the physical properties of said crude oil sands.

13. The method of claim 12, further comprising:

pre-treating said crude oil sands prior to said subjecting.

14. The method of claim 13, wherein said pretreating comprises dehumidifying said crude oil sands.

15. The method of claim 14, wherein said pre-treating further comprises treating said crude oil sands with at least one of extraction and processing agents.

16. The method of claim 1, further comprising:

monitoring changes in the physical properties of said crude oil sands; and adjusting the vibration based on changes in the physical properties of said crude oil sands.

17. The method of claim 16, further comprising:

pre-treating said crude oil sands prior to said subjecting.

18. The method of claim 17, wherein said pretreating comprises dehumidifying said crude oil sands.

19. The method of claim 18, wherein said pre-treating further comprises treating said crude oil sands with at least one of extraction and processing agents.

20. The method of claim 16, comprising using a plurality of vibration sources at each of said zones to create said vibration.

21. A method for separating bitumen from crude oil sands comprising the steps of:

subjecting the crude oil sands to a dewatering procedure to remove water from said crude oil sands;

moving the crude oil sands along a downwardly generally spiral travel path;

at different zones along said travel path, subjecting the crude oil sands to vibration having linear and torsional components, vibrational waves at said zones meeting resulting in pressure pulse wave incursion, the pressure pulse wave incursion creating destructive vibrational wave interference at the zones that causes bitumen to separate from crude oil sands; and filtering the separated bitumen from said crude oil sands.

22. The method of claim 21, comprising using a plurality of vibration sources at each of said zones to create said vibration.

23. The method of claim 22, further comprising:

monitoring changes in the physical properties of said crude oil sands; and adjusting the vibration based on changes in the physical properties of said crude oil sands.

24. The method of claim 23, further comprising, prior to subjecting the crude oil sands to vibration, catalyzing the crude oil sands.

25. The method of claim 21, further comprising:

monitoring changes in the physical properties of said crude oil sands; and adjusting the vibration based on changes in the physical properties of said crude oil sands.

26. The method of claim 25, further comprising, prior to subjecting the crude oil sands to vibration, catalyzing the crude oil sands.

* * * * *